US006985679B2

(12) United States Patent
Koh et al.

(10) Patent No.: US 6,985,679 B2
(45) Date of Patent: Jan. 10, 2006

(54) IMAGE FORMING APPARATUS WITH CLEANING OPERATION FOR SPECIAL SHEETS

(75) Inventors: Shokyo Koh, Ibaraki (JP); Eiichi Motoyama, Tokyo (JP); Mitsuhiko Sato, Chiba (JP); Takashi Fujimori, Ibaraki (JP); Hidenori Sunada, Ibaraki (JP); Hideyuki Ikegami, Chiba (JP); Satoru Yamamoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/357,360

(22) Filed: Feb. 4, 2003

(65) Prior Publication Data

US 2003/0156851 A1 Aug. 21, 2003

(30) Foreign Application Priority Data

Feb. 6, 2002 (JP) ..... 2002-030056
Mar. 18, 2002 (JP) ..... 2002-074974

(51) Int. Cl.
*G03G 15/00* (2006.01)

(52) U.S. Cl. ..... 399/45

(58) Field of Classification Search ..... 399/45, 399/66, 99, 101, 46, 71
See application file for complete search history.

(56) References Cited

U.S. PATENT DOCUMENTS

| | | | | |
|---|---|---|---|---|
| 5,325,166 A | * | 6/1994 | Hamilton et al. | 399/33 |
| 5,452,062 A | * | 9/1995 | Baldwin et al. | 399/382 |
| 5,504,565 A | * | 4/1996 | Tomiki et al. | 399/297 |
| 5,671,163 A | * | 9/1997 | Iida | 364/562 |
| 5,722,029 A | * | 2/1998 | Tomidokoro et al. | 399/389 |
| 5,822,648 A | | 10/1998 | Mohri | 399/46 |
| 5,848,320 A | | 12/1998 | Yaginuma et al. | 399/45 |
| 6,393,232 B1 | | 5/2002 | Osari et al. | 399/82 |

FOREIGN PATENT DOCUMENTS

| | | | |
|---|---|---|---|
| JP | 8-194416 | * | 7/1996 |
| JP | 2000214664 A | * | 8/2000 |

* cited by examiner

*Primary Examiner*—Quana Grainger
(74) *Attorney, Agent, or Firm*—Fitzpatrick, Cella, Harper & Scinto

(57) ABSTRACT

An image forming apparatus including an image forming unit for forming an image on a recording sheet including a special sheet, and a controller for allowing the image forming unit to carry out an image forming sequence which forms an image on the recording sheet, wherein the controller allows the image forming unit to control a cleaning operation of the image forming unit in response to image formation on the special sheet by the image forming unit.

17 Claims, 15 Drawing Sheets

TAB ORIGINAL SHEETS

RECORDED TAB SHEETS

START
S4001
START ?
NO
YES
S4002
COLOR IMAGE FORMATION ?
NO
YES
S4003
MARKING 137A DETECTED ?
NO
YES
S4004
TRANSFER IMAGE ON AREA A
S4005
SMALL SIZE ?
NO
YES
S4006
TAB SHEET & IMAGE OF SMALL SIZE PLUS TAB ?
YES
NO
S4007
MARKING 137B DETECTED ?
NO
YES
S4008
TRANSFER IMAGE ON AREA B
S4009
BLACK IMAGE FORMED ?
NO
YES
S4010
LAST IMAGE FORMED ?
NO
YES
EXIT
S4011
MARKING 137A OR 137B DETECTED ?
NO
YES
S4012
TRANSFER BLACK IMAGE

IMAGE FORMING APPARATUS WITH CLEANING OPERATION FOR SPECIAL SHEETS

BACKGROUND OF THE INVENTION

1. Field of the Invention

The present invention relates to an image forming apparatus capable of forming an image, which has a function for forming an image on a special sheet such as a tab sheet by an electrostatic system or an electrophotographic recording system.

2. Related Background Art

A conventional color image forming apparatus employs a transfer mechanism in which an image developed on a photosensitive drum is transferred to an intermediate transfer belt, and the image is further transferred from the intermediate transfer belt to a recording sheet. In this transfer mechanism, the image on the intermediate transfer belt is pulled (or attracted) by a transfer roller provided on a back surface of the recording sheet, thereby transferring the image on the recording sheet. According to this transfer mechanism, since images can stably be transferred irrespective states of sheets such as warpage or end portions of sheets, the transfer mechanisms are widely employed in color image forming apparatuses.

According to such a transfer mechanism, however, when an image is transferred from the intermediate transfer belt by a transfer roller, if the recording sheet does not exist on a transfer portion, the image is adversely transferred onto the transfer roller and as a result, there is a problem that a back surface of a recording sheet which is fed to the transfer portion next is contaminated. To solve such a problem, in the case of recording sheets having regular sizes, it is possible to prevent the transfer roller from pulling the image when the recording sheet does not exist on the transfer portion by controlling voltage of the transfer roller. When an image is to be formed on a tab portion of a tab sheet (tab is located at a rear end of the tab sheet), it is necessary to maintain the voltage of the transfer roller so that the image is attracted toward the transfer roller at least until the rear end of the tab portion passes through the transfer portion. When the tab portion of the tab sheet exist on the transfer portion, however, the tab portion is sandwiched between the intermediate transfer belt and the transfer roller, but in the portion of the sheet other than the tab, there is nothing between the intermediate transfer belt and the transfer roller. Therefore, when an image whose tab position is not correct is placed on the intermediate transfer belt, there is a problem that the transfer roller is contaminated. When an original image is copied on a tab sheet, if the original is not a tab sheet but a sheet having a regular size, such a problem is prone to be generated.

SUMMARY OF THE INVENTION

It is an object of the present invention to provide the following image forming apparatus. An image forming apparatus comprising: an image forming unit for forming an image on a recording sheet including a special sheet; and a controller for allowing the image forming unit to carry out an image forming sequence which forms an image on the recording sheet, wherein the controller allows the image forming unit to control a cleaning operation of the image forming unit in response to image formation on the special sheet by the image forming unit.

It is another object of the invention to provide the following image forming apparatus. An image forming apparatus comprising: an image forming unit for forming an image on a recording sheet including a special sheet; and a controller for sending the recording sheets at predetermined recording sheet distances from one another to the image forming unit, wherein the controller sends the recording sheets at longer recording sheet distances than the predetermined recording sheet distances to the image forming unit in response to image formation on the special sheet by the image forming unit.

It is another object of the invention to provide the following image forming apparatus. An image forming apparatus comprising: an image forming unit for forming an image on a recording sheet including a special sheet by an image-carrier; and a controller for controlling timing for allowing the image-carrier to carry images such that the image-carrier carries the images at predetermined image distances from one another, wherein the controller controls the timing for allowing the image-carrier to carry the images such that the image-carrier carries the images at longer image distances from one another than the predetermined image distances in response to image formation on the special sheet by the image forming unit.

It is another object of the invention to provide the following image forming apparatus. An image forming apparatus comprising: an image-carrier for carrying a developer; a transferring device for transferring the developer carried by the image-carrier to a recording sheet; and a controller which selectively carries out first control for controlling the transfer device such that the developer carried by the image-carrier is transferred to the recording sheet, and second control for controlling the transfer device such that a developer which adheres to the transfer device is transferred to the image-carrier, wherein when the developer is transferred to a special sheet, the controller controls the transfer device by the first control and then, controls the transfer device by the second control.

It is another object of the invention to provide the following image forming apparatus. An image forming apparatus comprising: an image-carrier for carrying images; a transfer device for transferring the images carried by the image-carrier to a recording sheet; and a controller for controlling a distance between a rear end of the image carried on the image-carrier and a leading end of a next image in accordance with a kind of the recording sheet.

Other features and advantages of the present invention will become apparent in the following description and the accompanying drawings.

DESCRIPTION OF THE PREFERRED EMBODIMENTS

Embodiments of the present invention will be explained with reference to the drawings below.

(First Embodiment)

Figure 1:
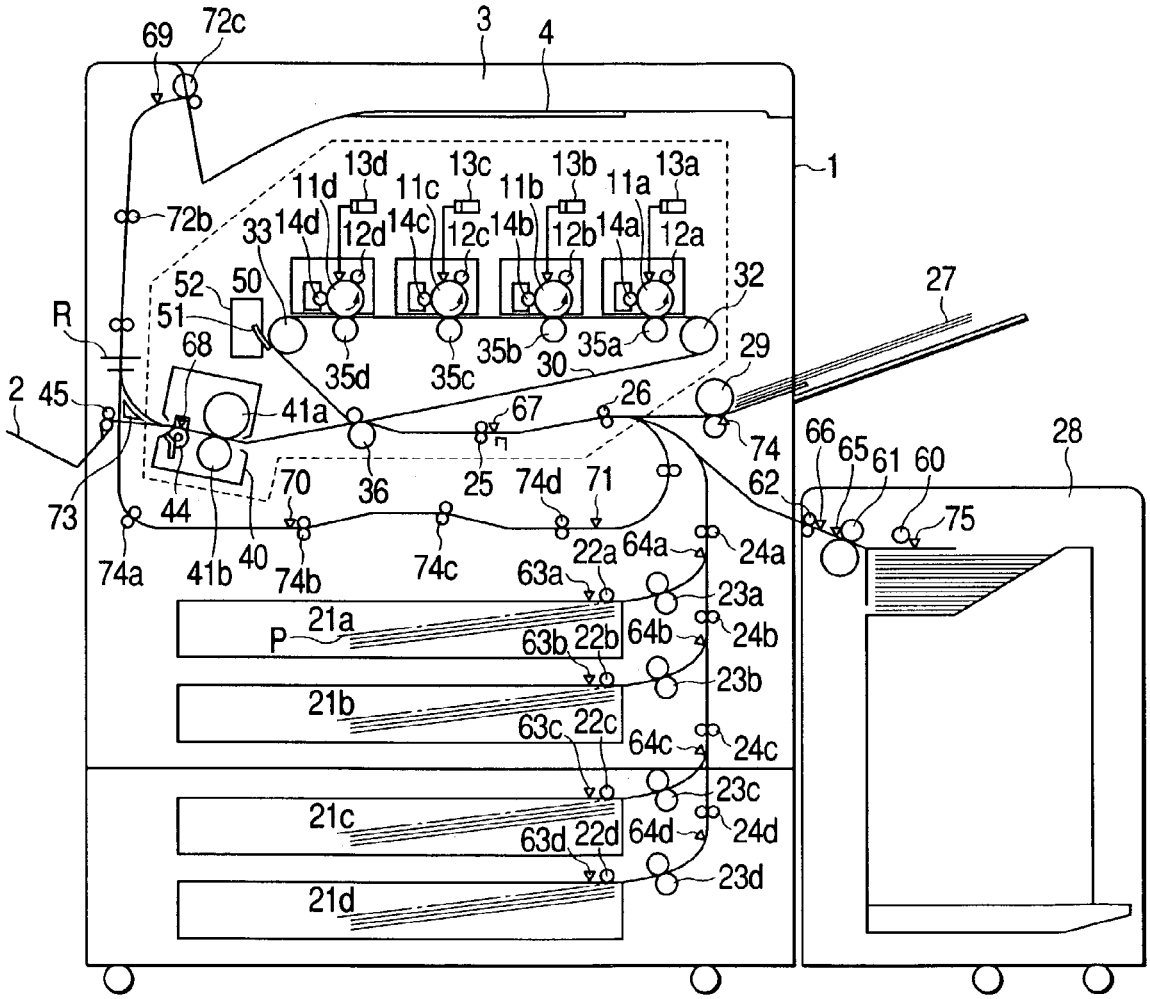
FIG. 1 is a sectional view for explaining an image forming apparatus of a first embodiment of the present invention.

FIG. 1 is a sectional view for explaining an example of a structure of an image of a first embodiment of the present invention. In FIG. 1, the image forming apparatus is explained as an electrophotographic image forming apparatus. Reference numeral 1 represents the image forming apparatus, and the image forming apparatus generally comprises an image forming unit (four stations a, b, c and d are arranged in parallel, and structure thereof are the same), a sheet feeding unit, an intermediate transfer unit, a conveying unit, a fixing unit, an operating unit and a control unit.

These units will be explained in detail. First, the image forming unit has the following structure. That is, photosensitive drums 11*a*, 11*b*, 11*c* and 11*d* as image-carriers are rotatably supported at their axes, and they are rotated by a driving motor (not shown) in a direction shown with an arrow in FIG. 1. Roller chargers 12*a*, 12*b*, 12*c*, 12*d*, scanners 13*a*, 13*b*, 13*c*, 13*d*, developing devices 14*a*, 14*b*, 14*c*, 14*d* are disposed to be opposed to outer peripheries of the photosensitive drums 11*a* to 11*d* in the rotation direction of the photosensitive drums. Electric charges having uniform charge amount are given to surfaces of the photosensitive drums 11*a* to 11*d* by the roller charger 12*a* to 12*d* and then, the photosensitive drums 11*a* to 11*d* are exposed with light beams such as laser beams which are modulated according to a recording image signal, by the. scanners 13*a* to 13*d*, thereby forming an electrostatic latent image there.

This electrostatic latent image is visualized by the developing devices 14*a* to 14*d* which accommodate four color developers (toner) such as yellow, cyan, magenta and black. This visualized visible image is transferred to an intermediate transfer body 30. With such a process, images are formed by each toner in succession.

The sheet feeding unit comprises a section for accommodating recording sheets P, a roller for conveying the recording sheet P, a sensor for detecting the passage of the recording sheet P, a sensor for detecting the presence or absence of the recording sheet P, and a guide (not shown) for conveying the recording sheets P along a conveying path. In the drawing, reference numerals 21*a*, 21*b*, 21*c*, 21*d* represent cassettes, reference numeral 27 represents a manual feeding tray, and a deck 28 accommodates the recording sheets P. Reference numbers 22*a*, 22*b*, 22*c*, 22*d* represent pickup rollers for sending the recording sheets P one sheet by one sheet from the cassettes 21*a* to 21*d*.

A plurality of recording sheets P may be sent out from the pickup rollers 22*a* to 22*d*, but the recording sheets P are reliably sent one sheet by one sheet by BC rollers 23*a*, 23*b*, 23*c*, 23*d*. One recording sheet P which was separated by the BC rollers 23*a*, 23*b*, 23*c*, 23*d* is further conveyed to a regist roller 25 by pulling-out rollers 24*a* to 24*d* and a regist-front roller 26. Recording sheets P accommodated in the manual feeding tray 27 are separated one sheet by one sheet by a BC roller 29, and are conveyed to the regist roller 25 by the regist-front roller 26. A plurality of recording sheets P accommodated in the deck 28 are transferred to a sheet feed roller 61 by a pickup roller 60, and they are reliably separated one sheet by one sheet by the sheet feed roller 61, and are conveyed to a pulling-out roller 62. The recording sheets P are further conveyed the regist roller 25 by the regist-front roller 26.

Next, the intermediate transfer unit will be explained in detail. Reference numeral 30 represents an intermediate transfer belt, and polyethylene terephthalate (PET) or polyvinylidene fluoride (PVdF) is used as a material thereof. Reference numeral 32 represents a driving roller for transmitting the driving force to the intermediate transfer belt 30. The driving roller 32 is supported by a tension roller 33 and driven rollers 34. The tension roller 33 gives an appropriate tension to the intermediate transfer belt 30 by a biasing force of a spring (not shown). The driven rollers 34 sandwich the intermediate transfer belt 30 to form a secondary transfer area. The driving roller 32 has a metal roller surface coated with rubber (urethane or chloroprene) having several millimeters. The driving roller 32 prevents slip with respect to the belt. The driving roller 32 is rotated by a stepping motor (not shown).

Primary transfer rollers 35*a* to 35*d* for applying high voltage to transfer a toner image to the intermediate transfer belt 30 are disposed on a back side of the intermediate transfer belt 30 at a position where the photosensitive drums 11*a* to 11*d* and the intermediate transfer belt 30 are opposed to each other. A secondary transfer roller 36 is opposed to the driven roller 34, and a secondary transfer area is formed by a nip between the roller 36 and the intermediate transfer belt 30.

The secondary transfer roller 36 is pressed against the intermediate transfer body under an appropriate pressure. A cleaning device 50 for cleaning an image forming surface of the intermediate transfer belt 30 is disposed on the intermediate transfer belt 30 downstream of the secondary transfer area. The cleaning device 50 comprises a cleaner blade 51 (polyurethane rubber or the like is used as its material) and a waste toner box 52 for accommodating waste toner.

A fixing unit 40 comprises a fixing roller 41*a* having a heat source such as a halogen heater therein, a roller 41*b* pressed by the fixing roller 41*a* (the roller 41*b* includes a heat source in some cases), and a sheet discharge roller 44 for conveying recording sheets P discharged from the above pair of rollers.

The recording sheets P conveyed to the regist roller once stop the rotation of rollers existing upstream of the regist roller, and rotation of the upstream rollers including a regist roller 25 is started again with image forming timing of the image forming unit. The recording sheets P are sent to the secondary transfer area and the image is transferred to the secondary transfer area, the recording sheets P on which the image was fixed in the fixing unit 40 pass through the sheet discharge roller 44 and then, the sending destination is switched by a flapper 73.

When the switching flapper 73 is on a face up sheet discharge side, the recording sheets P are discharged to a face up sheet discharge tray 2 by a sheet discharge roller 45. When the switching flapper 73 is on a face down sheet discharge side, the recording sheets P are sent toward inversion rollers 72*a*, 72*b*, 72*c*, and discharged to a face down sheet discharge tray 3. A plurality of sensors for detecting the passage of the recording sheets P are disposed on a conveying path of the recording sheets P. Examples of such sensors are sheet feed retry sensors 64*a*, 64*b*, 64*c*, 64*d*, a deck sheet feed sensor 65, a deck pulling-out sensor 66, regist sensor 67, a sheet discharge sensor 68, a face down sheet discharge sensor 69, a dual side pre-registration sensor 70, a dual side sheet refeed sensor 71 and the like.

Cassette sheet-presence or absence sensors 63*a*, 63*b*, 63*c*, 63*d* for detecting the presence or absence of the recording sheets P are disposed on the cassettes 21*a* to 21*d* which accommodate the recording sheets P. A manual feeding tray sheet-presence or absence sensor 74 for detecting the presence or absence of the recording sheets P on the multi-manual feeding tray 27 is disposed in the multi-manual feeding tray 27. A deck sheet-presence or absence sensor 75 for detecting the presence or absence of the recording sheets P in the deck 28 is disposed in the deck 28.

The control unit comprises a control substrate (not shown) for controlling the operation of mechanisms in the above-described units and a motor drive substrate (not shown).

An operating unit 4 is disposed on an upper surface of the image forming apparatus 1. An operating unit 4 can select sheet feeding units (the sheet feed cassette 21*a* to 21*d*, the manual feeding tray 27, the deck 28), and sheet discharge trays (the face up tray 2, the face down tray 3), and can designate tab sheets.

Next, the operation of the apparatus will be explained. As one example thereof, a case in which recording sheets P are conveyed from the cassette 21*a* will be explained.

After a predetermined time is elapsed after an image forming operation starting signal is sent, recording sheets P are first sent out one sheet by one sheet from the cassette 21*a* by the pickup roller 22*a*. The recording sheets P are conveyed to the regist roller 25 through the pulling-out roller 24*a* and the regist-front roller 26 by the sheet feed roller 23*a*. At that time, the regist roller 25 is stopped, and a leading end of the sheet abuts against the nip portion. Thereafter, the regist roller 25 starts rotating when the image forming unit starts forming an image. This rotation timing is set such that the recording sheet P and a toner image which is primary transferred onto the intermediate transfer belt 30 by the image forming unit just coincide with each other in the secondary transfer area.

In the image forming unit, if the image forming operation starting signal is sent, a toner image formed on the photosensitive drum 11*d* which is located most upstream in the rotation direction of the intermediate transfer belt 30 is primary transferred, by the above-described process, to the intermediate transfer belt 30 in a primary transfer area by the primary transfer roller 35*d* to which high voltage is applied. The primary transferred toner image is conveyed to a next primary transfer area. In the next primary transfer area, image formation is executed with a delay corresponding to time for conveyance of the toner image between the image forming units, and the leading end of the image is aligned on a former image and a next toner image is transferred. Thereafter, the same steps are repeated, and a toner image having four colors is finally primary transferred onto the intermediate transfer belt 30.

Then, if the recording sheets P approach the secondary transfer area and come into contact with the intermediate transfer belt 30, high voltage is applied to the secondary transfer roller 36 in accordance with a passing timing of the recording sheets P. Then, the four color toner image formed on the intermediate transfer belt 30 by the above process is transferred to a surface of the recording sheet P. Thereafter, the recording sheets P are guided to the nip portion of a pair of fixing rollers 41*a*, 41*b*, the toner image is fixed on the sheet surface by heat of the pair of rollers 41*a* and 41*b* and a pressure of the nip, and the recording sheets P are discharged to the face up sheet discharge tray 2 or the face down tray 3 in a switching direction of the switching flapper.

Figure 2:
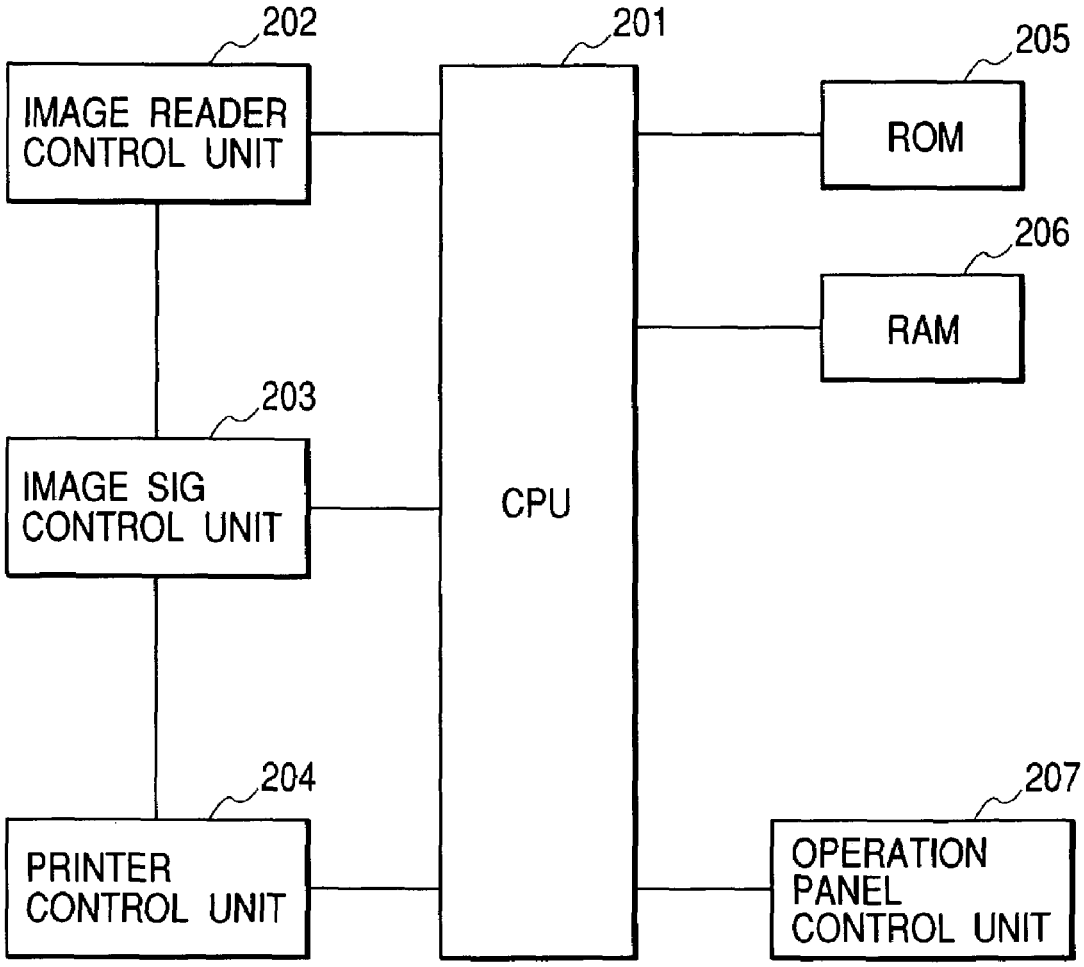
FIG. 2 is a block diagram for showing a structure of a control unit which controls the image forming apparatus.

FIG. 2 is a block diagram showing a structure of the control unit which controls the image forming apparatus 1. The control unit comprises a CPU 201, an image reader control unit 202, an image signal control unit 203, a printer control unit 204, a ROM 205, a RAM 206, and an operation panel control unit 207.

By executing a program stored in the ROM 205, the CPU 201 controls an original reading unit (not shown) through the image reader control unit 202. Reference numeral 203 represents an image signal control unit. The image signal control unit 203 accumulates image data of an original read by the original reading unit (not shown) or image data input to the image signal control unit through a network, and outputs print data to the printer control unit 204.

Next, when an image from the image reading unit is formed (copied) by the image forming apparatus 1 shown in FIG. 1 and a tab sheet insert mode and a tab sheet preparing mode using tab sheets, setting in the operating unit 4 is conducted as hereinbelow. In this embodiment, the image forming apparatus 1 is explained as a copier, but the image forming operation can be carried out in the same manner even if the operation is a printing operation from a network.

Figure 3A:
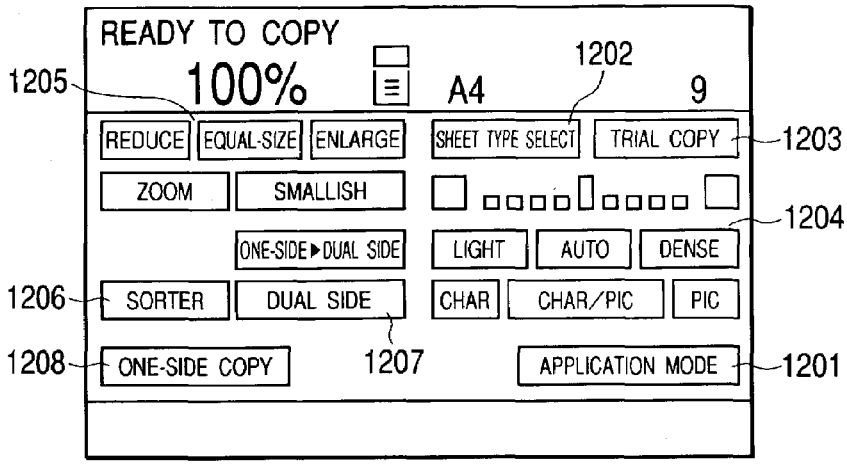
FIGS. 3A, 3B and 3C are views for explaining a liquid crystal screen provided on an operating unit of the image forming apparatus.

FIGS. 3A to 3C and 4A to 4C are views for explaining liquid crystal screen provided on the operating unit 4. FIG. 3A shows a standard screen on which basic settings of copy function are carried out.

If an icon 1201 of an application mode is pressed down, a sub-window for carrying out various mode settings is opened. A trial copy icon 1203 is used when there exist a plurality of copy images and only the first one is to be copied on a trial basis.

A key group 1204 for determining an image mode, selects image modes such as "auto density correction", "char mode", "char/picture mode", "picture mode" and the like. When the "char mode", "char/picture mode" or "picture mode" is selected, density can be changed by "light" or "dense" key.

In a key group 1205 for changing magnification of an original, a 100% "equal size" key, a "reduce" key, an "enlarge" key, a 1% by 1% "zoom" key, and a "smallish" key used for copying the entire original are included. In any cases, the key group 1205 are for changing magnification of the original, and after setting the magnification, the set magnification is indicated.

A "sorter" key 1206 is for setting the finishing after a sheet is output. For example, a sort mode used for changing one-volume output for a plurality of originals to plural-volume output, a group sort for outputting the set number of volumes for each page of the originals, and a staple mode for stapling the sheets output in the sort mode on volume basis are included.

A "dual side" key 1207 sets a dual side mode for reading or outputting the original or sheet on one side. A "one side/dual side" mode for reading one side of an original and outputting the information on dual side, a "dual side/dual side" mode for reading dual side of the original and outputting the information on dual side, a "dual side/one side" mode for reading dual side of the original and outputting the information on one side, and a page spread copy dual side mode for dividing one side of the original into two and outputting the information on dual side of a reading sheet, are included.

FIG. 3A shows an indication example in which the one side/dual side mode in the dual side mode is set, and balloons of "one side/dual side" on an upper portion of the dual side icon are indicated.

As a favorite function key 1208 which can use an arbitrary function like a shortcut, in FIG. 3A, the setting when one side copy is carried out is indicated, and if this key is pressed down, a one side copy mode is set.

Figure 3B:
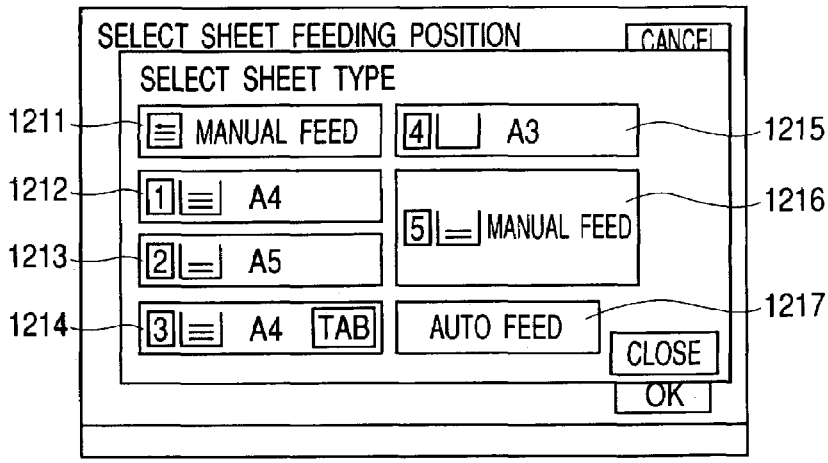

FIG. 3B shows a sub-window indicated when a "sheet type select" key 1202 shown in FIG. 3A is pressed down. In the sub-window, a sheet feed stage to be selected from the cassette decks 21*a*, 21*b*, 21*c*, 21*d*, the deck 28 and the multi-manual feeding tray 27 of the image forming apparatus body 1 is set.

At that time, an icon 1211 shows the multi-manual feeding tray 27, an icon 1212 shows the cassette 21*a*, and A4 sheets are inserted currently. An icon 1213 shows the cassette 21*b*, and A5 sheets are currently inserted. An icon 1214 shows that the cassette 21*c* is set as a tab sheet feeding stage, and this indicates that A4 tab sheets are currently inserted. According to such indication, a user can recognize that if he or she should set the tab sheets to which cassette, or the tab sheets are set to which cassette. An icon 1215 shows the cassette 21*d*, and this indicates that A3 sheet is currently set but there is no sheet. An icon 1216 indicates that A4 sheets are currently inserted to the deck 28. An icon 1217 is an auto feed selection key, and this key automatically detects appropriate sheets based on an original size and a set copy mode when the auto sheet is selected, and if such appropriate sheets could not be detected, a second candidate sheet size is selected.

Figure 3C:
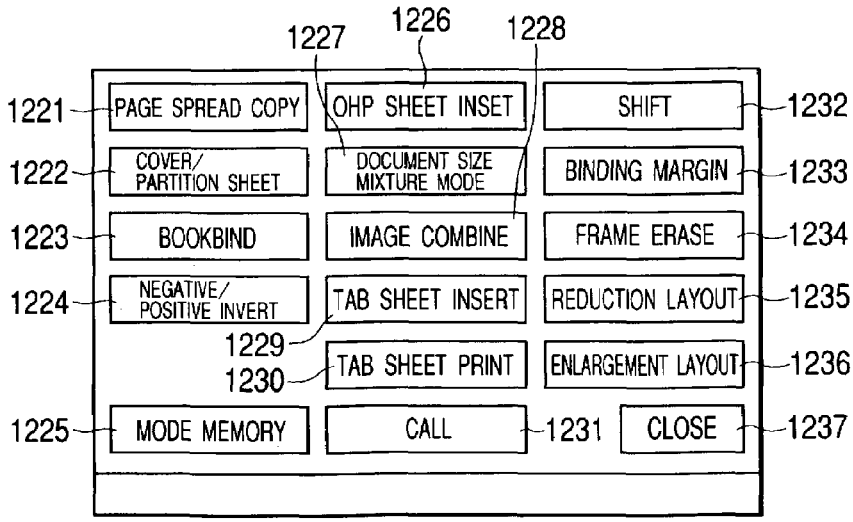

FIG. 3C shows a sub-window which appears when the application mode key 1201 is pressed down, and function icons for setting various copy modes are indicated. A "page spread copy" key 1221 executes a mode in which an original is recognized as a double-page spread, the spread is divided into two, and the information is read as two originals.

A "cover/partition sheet" key 1222 selects a sheet feed stage for a front sheet, a back sheet, or a partition sheet, and outputting one copy.

A "bookbind mode" key 1223 executes a mode for folding a recording sheet at a center thereof in a case of copying an original and for outputting the information as a double-page spread book.

A mode memory key 1225 is a key for collectively storing various mode settings such as the application mode, the sort mode set in the key 1206, variable magnification mode set in the key 1205, and the image mode set in the key 1204.

An "OHP inset" key 1226 is a key for setting a mode in which a transparency (OHP sheet) for OHP from the multi-manual feeding tray 27 is fed, printed, or the same image is printed on a normal sheet from another sheet feed stage when OHP sheets are set by the multi-manual feeding tray 27 or the like, or the OHP transparency inset sheet which is not printed and output is inserted between OHP transparencies.

A "mixed original" key 1227 executes a mode in which a plurality of kinds of originals are mounted in an original auto feeder (not shown) which automatically feeds originals to the image reading unit, and A4 sheets and A3 sheets are mixed.

An "image synthesizing" key 1228 registers a background image, or superpose a previously registered background image on an original and outputting the same.

A "tab sheet insert" key 1229 executes a tab sheet insert mode in which when there exists a tab sheet feeding stage as in the icon 1214 in the cassette 21*c* shown in FIG. 3B, a tab sheet is used as a dividing sheet such as the partition sheet, and an image is moved and printed on a tab based on a copy original corresponding to a tab portion.

A "tab sheet print" key 1230 executes a mode in which a tab sheet is fed, an image on an end of an original without tab is moved in a direction opposite from a sheet conveying direction, and printed on a tab portion of the tab sheet when there exists a tab sheet feeding stage like the icon 1214 of the cassette 21*c* shown in FIG. 3B.

A "call" key 1231 executes a mode for calling the setting at the time of last copy.

A "shift" key 1232 executes a mode for setting how a sheet on which an original image is to be output should be shifted.

A "binding margin" key 1233 executes a mode for moving an image for preparing a margin on a sheet on which an original image is to be output.

A "frame erase" key 1234 executes a mode for erasing an outer frame of an original image or erasing an image on an outer frame of a sheet at the time of printing.

A "reduction layout" key 1235 executes a mode which is set when a plurality of originals are laid out and printed on one sheet.

An "enlargement layout" key 1236 executes a mode for dividing and printing a plurality of images on one sheet prepared by the reduction layout or the like.

A "close" key 1237 is a key for closing the sub-window in the application mode and for returning to the standard screen shown in FIG. 3A.

Figure 4A:
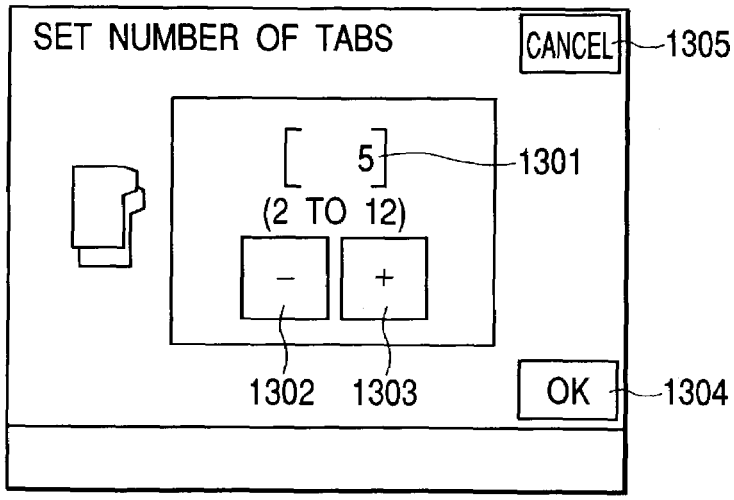
FIGS. 4A, 4B and 4C are views for explaining the liquid crystal screen provided on the operating unit of the image forming apparatus.

FIG. 4A shows a sub-window which is opened when the tab sheet insert key 1229 or the tab sheet copy key 1230 is pressed down. In the sub-window, the number of tabs (or the divisional number by tabs) is input. In general, a 5-tab-sheet is set, that is five tab sheets form one set. But in the above embodiment, from 2-tab-sheet in which two tab sheets form one set to 12-tab-sheet in which 12-tab-sheet form one set can be handled.

Here, "the number of tabs" is the number of tab sheets included in one set. In an area 1301, the number of tabs which is to be set currently is shown. The number of tabs can be increased or decreased by a "minus" key 1302 or a "plus" key 1303.

An "OK" key 1304 is a key for setting the input number of tabs.

A "cancel" key 1305 is pressed down when the sub-window for inputting the number of tabs to the sub-window of the application mode without setting the number of tabs.

Figure 4B:
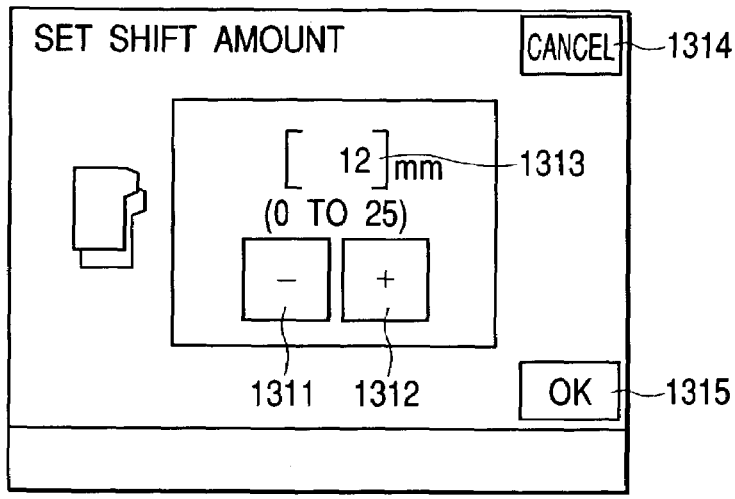

FIG. 4B shows a sub-window for setting a shift amount of a tab image after the "OK" key 1304 shown in FIG. 4A is pressed down. That is, the shift amount is an amount for shifting the tab image so as to print an image to be printed in a tab portion, included in an original, on the tab portion.

Usually, on an A4 size tab sheet, it is enough to shift a tab image by about 12 mm, but in the above embodiment, since the shift amount is varied in accordance with a size of characters to be printed on the tab or a position on the original, it is possible to set such that the tab image can be shifted by a width from 0 to 25 mm.

A "minus" key 1311 is a key for reducing 12 (mm) which is a normal shifting amount of a tab image, and a "plus" key 1312 is a key for increasing 12 (mm) which is the normal shifting amount of the tab image.

An indication section 1313 is a section where a shift amount to be set currently is indicated.

A "cancel" key 1314 is a key for canceling the setting of the shift amount and for returning to the input screen (FIG. 4A) for setting the number of tabs.

An "OK" key 1315 is a key for reflecting a value indicated in the indication section 1313 at the time of printing.

Figure 4C:
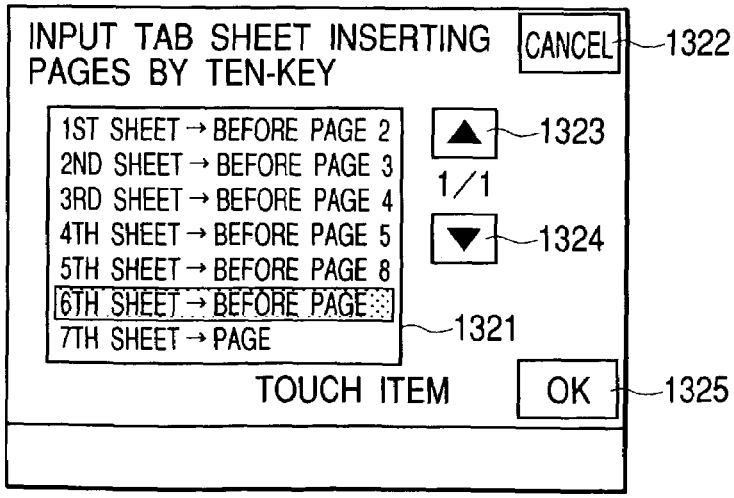

Next, as shown in FIG. 4C, a page (tab sheet inserting page) which indicates a position where a tab sheet is inserted is set.

In an insert page window 1321 showing a page where the tab sheet is inserted, when a first tab sheet is selected, "first sheet" is pressed down, and a page number in which the tab sheet is to be inserted is input using a numeric keypad (not shown) on the operating unit.

In the above embodiment, as shown in FIG. 4C, an inserting position of the first tab sheet is set before page 2. Similarly, an inserting position of a second tab sheet is set before page 3, an inserting position of a third tab sheet is set before page 4, an inserting position of a fourth tab sheet is set before page 5, and an inserting position of a fifth tab sheet is set before page 8.

A "cancel" key 1322 is a key for canceling an inserting position where a tab sheet is inserted, and returning to the sub-window (FIG. 4B) for setting the shift amount of an image of the tab image.

A scroll up key 1323 is for scrolling up the inserting page window 1321 when the number of pages where tab sheets are inserted is seven or more.

A scroll down key 1324 is for scrolling down the inserting page window 1321 when the number of pages where tab sheets are inserted is seven or more.

An "OK" key 1325 is an "OK" key for reflecting the inserting page of a tab sheet set by the inserting page window on a copy job, and with this, the setting of the tab sheet insert mode is completed.

With this setting, in a copy job, it is determined to which portion of one set of sheets a tab sheet should be inserted, how much the image shift amount should be set when information is printed on a tab portion, and on which page the tab sheet should be fed, based on the number of tabs, the tab image shift amount and the inserting page of the tab sheet which are set in FIGS. 4A to 4C.

Figure 5A:
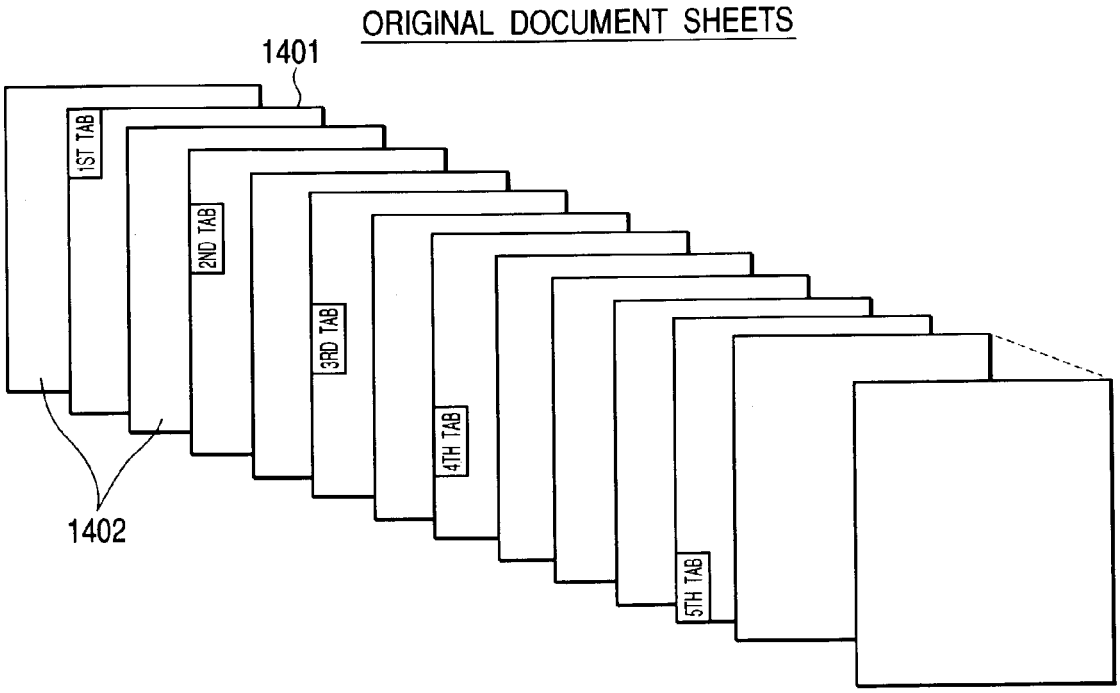
FIGS. 5A and 5B are views showing examples of originals and recording sheets on which images are to be copied in accordance with tab sheet insert settings.
Figure 5B:
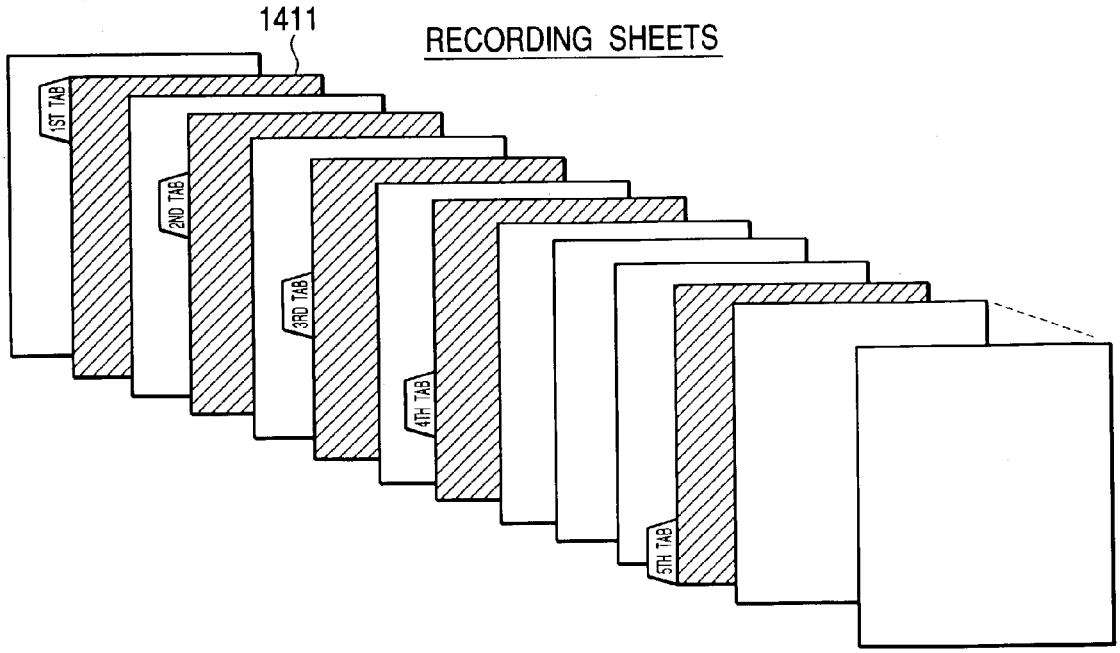

FIGS. 5A and 5B show examples of an original (FIG. 5A) and a recording sheet (FIG. 5B) which are copied in accordance with the tab sheet insert key 1229 and the tab sheet insert setting which is set in FIGS. 4A to 4C. At the time, although a size of the original and a size of a sheet coincide with each other, a size of a tab original sheet and a size of a tab sheet are different only in a tab portion.

A tab original sheet 1401 is an original which is sandwiched between originals 1402 and which is printed (image is formed) on a tab sheet. A recording sheet which is output in corresponding to this tab original is shown in FIG. 5B. An image which was printed on the tab original sheet 1401 is shifted by a shift amount set in FIG. 4B and is printed on a tab portion of a tab sheet 1411.

Figure 6A:
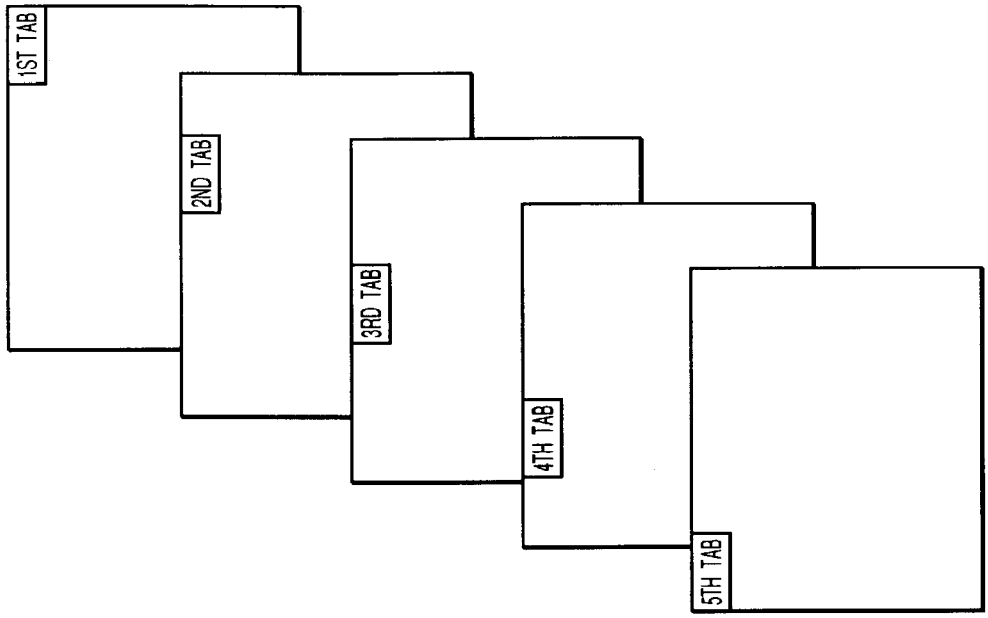
FIGS. 6A and 6B are views showing examples of originals and recording sheets on which images are to be copied in accordance with tab sheet preparing mode settings.
Figure 6B:
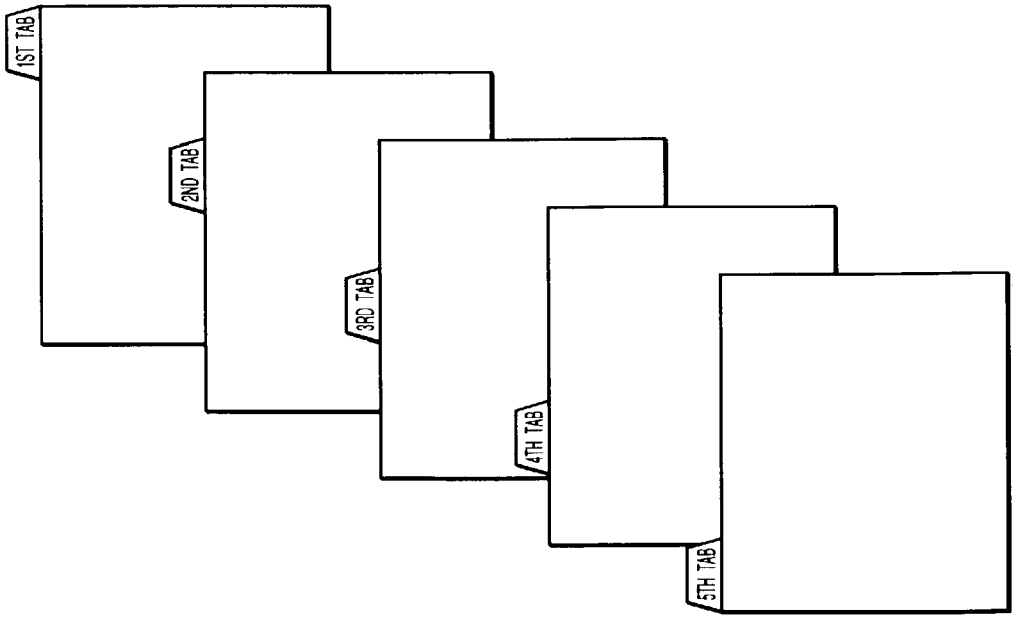

FIGS. 6A and 6B show examples of originals (tab original sheets: FIG. 6A) which are to be copied by the tab sheet preparing by 1230 and the tab sheet preparing mode setting which is set in FIGS. 4A and 4B, and recording sheets (output tab sheets: FIG. 6B) which are copied. Although a size of the original and a size of a sheet coincide with each other, a size of a tab original sheet and a size of a tab sheet are different only in a tab portion. Recording sheets which are output in corresponding to the different size are shown in FIG. 6B. An image printed on the tab original sheet shown in FIG. 6A is moved by a shift amount set in FIG. 4B and is printed on a tab portion of the tab sheet.

Next, control of the secondary transfer roller 36 for transferring an image of the intermediate transfer belt 30 onto a recording sheet according to the embodiment will be explained.

Figure 7:
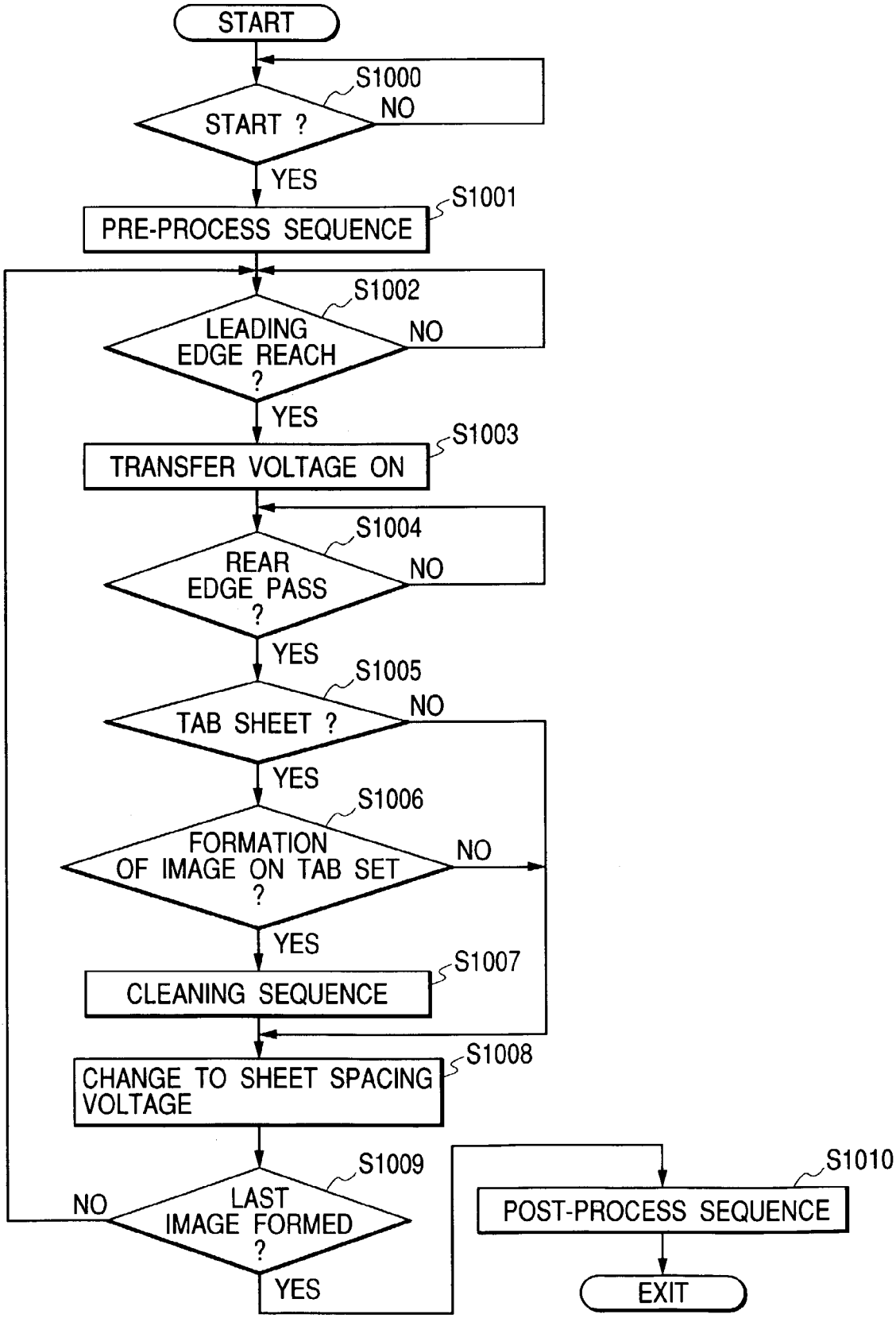
FIG. 7 is a flowchart for explaining control of a secondary transfer roller of the image forming apparatus.

FIG. 7 is a flowchart for explaining the control of the secondary transfer roller 36. The processing is called at regular time intervals or if necessary by main sequence. A program for executing this flowchart is stored in the ROM 205, and is read out and executed by the CPU 201.

First, in step S1000, it is judged whether or not an image forming operation is started. If it is judged that the image forming operation is not started in step S1000 (S1000: No), the procedure is returned to step S1000 to wait until the image forming operation is started. If it is judged that the image forming operation is started in step S1000 (S1000: Yes), the procedure is proceeded to step S1001.

In step S1001, a pre-processing for the image forming operation is carried out. This pre-processing establishes a state in which an image can be transferred to a recording sheet by the secondary transfer roller 36. For example, predetermined voltage is applied to the secondary transfer roller 36, flowing current is measured to determine transfer voltage, cleaning sequence of the secondary transfer roller 36 which will be described later is executed, and standby voltage before the image is transferred is output. Then, the procedure is proceeded to step S1002.

In step S1002, it is judged whether or not an image formed by the photosensitive drums 12*a* to 12*d* and placed on the intermediate transfer belt 30 by the primary transfer rollers 35*a* to 35*d* has reached a position of the secondary transfer roller 36. In step S1002, if it is judged that the image on the intermediate transfer belt 30 has not yet reached the position of the secondary transfer roller 36 (step S1002: No), the procedure is returned to step S1002 to wait until the image reaches. If it is judged that the images has reached the position of the secondary transfer roller 36 in step S1002 (S1002: Yes), the procedure is proceeded to step S1003.

In step S1003, transfer voltage is output as voltage of the secondary transfer roller 36 for transferring an image from the intermediate transfer belt 30 to a recording sheet. When it is judged whether or not the image has reached the position of the secondary transfer roller 36 in step S1002, it is possible to fast judge,the response time of the transfer voltage output in step S1003. After the transfer voltage of the secondary transfer roller 36 is brought into image transfer voltage in step S1003, procedure is proceeded to step S1004.

In step S1004, it is judged whether or not an image length transferred to the intermediate transfer belt 30 has passed through the secondary transfer roller 36. If it is judged that the length has not yet passed in step S1004 (S1004: No), the procedure is returned to step S1004 to wait until the length passes. If it is judged that the length has passed in step S1004 (S1004: Yes), the procedure is proceeded to step S1005.

In step S1005, it is judged whether or not the recording sheet on which the image was transferred by the secondary transfer roller 36 is a tab sheet. If it is judged that the recording sheet is not the tab sheet in step S1005 (S1005: No), the procedure is proceeded to step S1008. If it is judged that the recording sheet is the tab sheet in step S1005 (S1005: Yes), the procedure is proceeded to step S1006.

In step S1006, it is judged whether or not it was set to form the image on a tab portion of the tab sheet on the basis of the setting of the shift amount of the image as explained in FIGS. 4A to 4C, the size of the original image and the size of the tab sheet. If it is judged that it was set not to form the image on the tab portion in step S1006 (S1006: No), the procedure is proceeded to step S1008. If it was set to form the image on the tab portion in step S1006 (S1006: Yes), the procedure is proceeded to step S1007.

In step S1007, cleaning processing of the secondary transfer roller 36 is carried out. In the cleaning processing of the secondary transfer roller 36, voltage having polarity opposite from that when the image of the intermediate transfer belt 30 is transferred to the recording sheet is applied to the secondary transfer roller 36 and in this state, if it is held for a predetermined time (e.g., time required for the secondary transfer roller 36 to rotate at least one revolution), toner is transferred from the secondary transfer roller 36 to the intermediate transfer belt 30. Toner adhered to the intermediate transfer belt 30 is cleaned by the cleaning device 50.

A time period during which voltage having the opposite polarity is applied to the secondary transfer roller 36 may be changed in accordance with a length of the image to be placed on the tab portion, i.e., the shift amount explained in FIGS. 4A to 4C, the size of the original and the size of the tab sheet.

In a case the cleaning processing of the secondary transfer roller 36 is carried out, when an image is formed on a tab portion of the tab sheet, a space in which the cleaning processing can be carried out is left between an image to be formed on the tab sheet and an image to be formed on the recording sheet which is supplied after the tab sheet, and the next image is formed. In other words, in a case the cleaning processing of the secondary transfer roller 36 is carried out, when an image is formed on a tab portion of the tab sheet, an enough distance for carrying out the cleaning processing is left between a rear end of the tab sheet and a leading end of a recording sheet which is supplied after the tab sheet, and a next recording sheet is supplied.

If the cleaning processing of the secondary transfer roller 36 is completed in step S1007, the procedure is proceeded to step S1008.

In step S1008, voltage of the secondary transfer roller 36 is changed to voltage (voltage which does not attract toner from the intermediate transfer belt 30 to the secondary transfer roller 36) for sheet spacing (a state in which transferring unit has not recording sheets), and the procedure is proceeded to step S1009.

In step S1009, it is judged whether or not an image transferred to the recording sheet is a final image of image forming. If it is judged that the image is not final in step S1009 (S1009: No), the processing is returned to step S1002 where the following steps are repeated. If it is judged that the image is final (S1009: Yes), the procedure is proceeded to step S1010.

In step S1010, post-processing for completing the image forming operation is carried out. In this post-processing, the cleaning sequence of the secondary transfer roller 36 is carried out, voltage of the secondary transfer roller 36 is turned off and the flow is proceeded to the exit.

In this embodiment, control is switched, when the sheet is a tab sheet and further an image is formed on the tab sheet. But the same effect can be obtained even if the control is switched when the sheet is the tab sheet.

Although the procedure is proceeded to step S1007 if it is judged that it is a tab sheet in step S1005, and that an image is set to be formed on the tab portion, if it is judged that it is a tab sheet in step S1005, the procedure may be proceeded to step S1007 (without through step S1006), and if it is judged that it is not the tab sheet, the procedure may be proceeded to step S1008. In this case, the same effect can be obtained with easier judgment.

Further, in this embodiment, when images are formed on tab sheets, a distance between images is set larger than a distance between images when the images are formed on recording sheets other than tab sheets, a distance between recording sheets is set larger than a distance between recording sheets when the images are formed on the recording sheets other than the tab sheets, and the cleaning operation is carried out. However, the present invention is not limited to the tab sheets, and the invention can also be applied to a case in which an image is formed on a special sheet such as a pre-punch sheet which is previously formed with a hole and a non-rectangular sheet other than a rectangular sheet. That is, the present invention also includes such a structure that when images are formed on special sheets such as the pre-punch sheets or non-rectangular sheets, a distance between images is set larger than a distance between images when the images are formed on recording sheets other than tab sheets, a distance between recording sheets is set larger than a distance between recording sheets when the images are formed on the recording sheets other than the tab sheets and the cleaning operation is carried out.

Although the cleaning of the secondary transfer roller 36 is carried out by applying voltage having opposite polarity to the secondary transfer roller 36 in this embodiment, the cleaning may be carried out by a mechanical cleaning operation.

In the embodiment, an image formed by the photosensitive drum 35*a* to 35*d* is once transferred to the intermediate transfer belt 30 and is again transferred to the recording sheet. Alternatively, even if the image is directly transferred to the recording sheet from the photosensitive drum, the same effect can be obtained by carrying out the cleaning operation of the transferring roller 36 which presses the recording sheet against the photosensitive drum.

(Second Embodiment)

Figure 8:
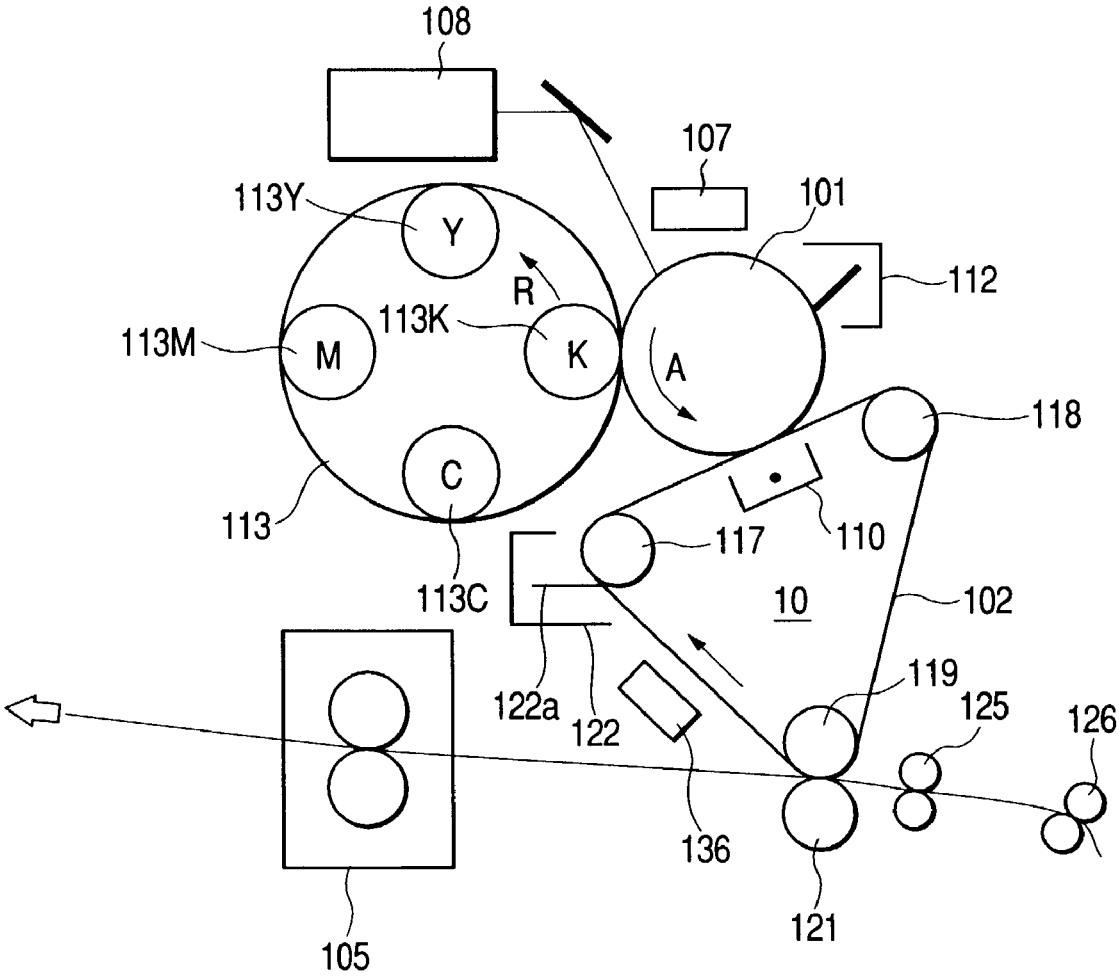
FIG. 8 is a view for explaining an image forming apparatus of a second embodiment of the present invention.

FIG. 8 is a view for explaining an image forming apparatus of a second embodiment of the present invention. FIG. 8 shows only a structure portion (portion surrounded by a broken line in FIG. 1) which is different from the image forming apparatus 1 having a structure explained in the first embodiment.

In this image forming apparatus, a photosensitive drum 101 as an image-carrier is provided so that the photosensitive drum 101 can be rotated by a motor (not shown) in a direction shown with an arrow A in FIG. 8. A primary charger 107, an exposure device 108, a developing unit 113, a transfer charger 110 and a cleaner device 112 are disposed around the photosensitive drum 101. A cleaning charger 111 is disposed in front of the cleaner device 112.

The developing unit 113 comprises four developing devices 113Y, 113M, 113C, 113K for developing in full color. The developing devices 113Y, 113M, 113C, 113K develop a latent image on the photosensitive drum 101 using toners of Y, M, C and K. When the image is developed using toner of respective colors, the developing unit 113 is rotated by a motor (not shown) in a direction of an arrow R in FIG. 8, and developing devices having these colors are positioned such that they abut against the photosensitive drum 101.

Respective colored toner images developed on the photosensitive drum 101 are transferred on an intermediate transfer belt 102 as an intermediate transfer body by the transfer device 110 in succession, and four color toner images are superposed on the intermediate transfer belt 102.

The intermediate transfer belt 102 is wound around rollers 117, 118 and 119. Of the rollers, the roller 117 is coupled to a driving source (not shown) and functions as a driving roller which drives the intermediate transfer belt 102. The roller 118 functions as a tension roller for adjusting tension of the intermediate transfer belt 102. The roller 119 functions as a backup roller of a transfer roller 121 as a secondary transfer device.

The belt cleaner 112 is provided at a position opposed to the roller 117 with the intermediate transfer belt 102 interposed therebetween. Toner residue on the intermediate transfer belt 102 is scraped off by a blade 122*a*.

The recording sheets are supplied to a nip portion, i.e., an abutting portion between the secondary transfer device 121 and the intermediate transfer belt 102 by a pair of rollers 125 and 126. A toner image formed on the intermediate transfer belt 102 is transferred onto a recording sheet by the nip portion of the secondary transfer device 121.

In the color image forming apparatus having such a structure, an image is formed in the following manner. First, voltage is applied to the charging device 107 so that a surface of the photosensitive drum 101 is negatively charged uniformly with predetermined potential at charging portion. Then, exposure is carried out by an exposure device 108 comprising a laser scanner so that the image portion on the charged photosensitive drum 101 becomes exposure portion potential, thereby forming a latent image. The exposure device 108 is turned ON and OFF based on an image signal to form a latent image corresponding to an image.

Developing bias which is previously set for each color is applied to a developing roller of the developing device such as 113Y, and a latent image is developed by the toner when the latent image passes through the position of the developing roller, and is visualized as a toner image. The toner image is transferred to the intermediate transfer belt 102 and is further transferred to a recording sheet by the secondary transfer device 121, and is supplied to a fixing device 105.

At the time of full color printing, the intermediate transfer belt 102 is rotated four times, four color toner particles are superposed on the belt, and then the toner is transferred to the recording sheet. Toner remaining on the photosensitive drum 101 establishes a state in which charge of toner can easily be cleaned by an auxiliary cleaning device, the toner is removed and collected by the cleaner device 112 and lastly, the photosensitive drum 101 is uniformly discharged to 0 volt by a discharging device (not shown) to prepare for a next image forming cycle.

The above-described color image forming timing is controlled taking a predetermined position on the intermediate transfer belt 102 as a reference. The intermediate transfer belt 102 is wound around the roller group comprising the driving roller 117, the tension roller 118 and the backup roller 119, and predetermined tension is applied to the intermediate transfer belt 102 by the tension roller 118.

A reflection type sensor 136 for detecting the reference position is disposed between the driving roller 117 and the roller 119. The reflection type sensor 136 detects a marking such as a reflection tape provided on an outer peripheral end of the intermediate transfer belt 102, and outputs an I-top signal. When predetermined time is elapsed after the I-top signal is detected, exposure by the exposure device 108 comprising a laser scanner is started.

As described above, the intermediate transfer belt 102 is rotated four times to superpose the image on the intermediate transfer belt 102 when a full color image is formed. Therefore, a peripheral length of the intermediate transfer belt 102 is longer than a maximum image forming size.

Figure 9:
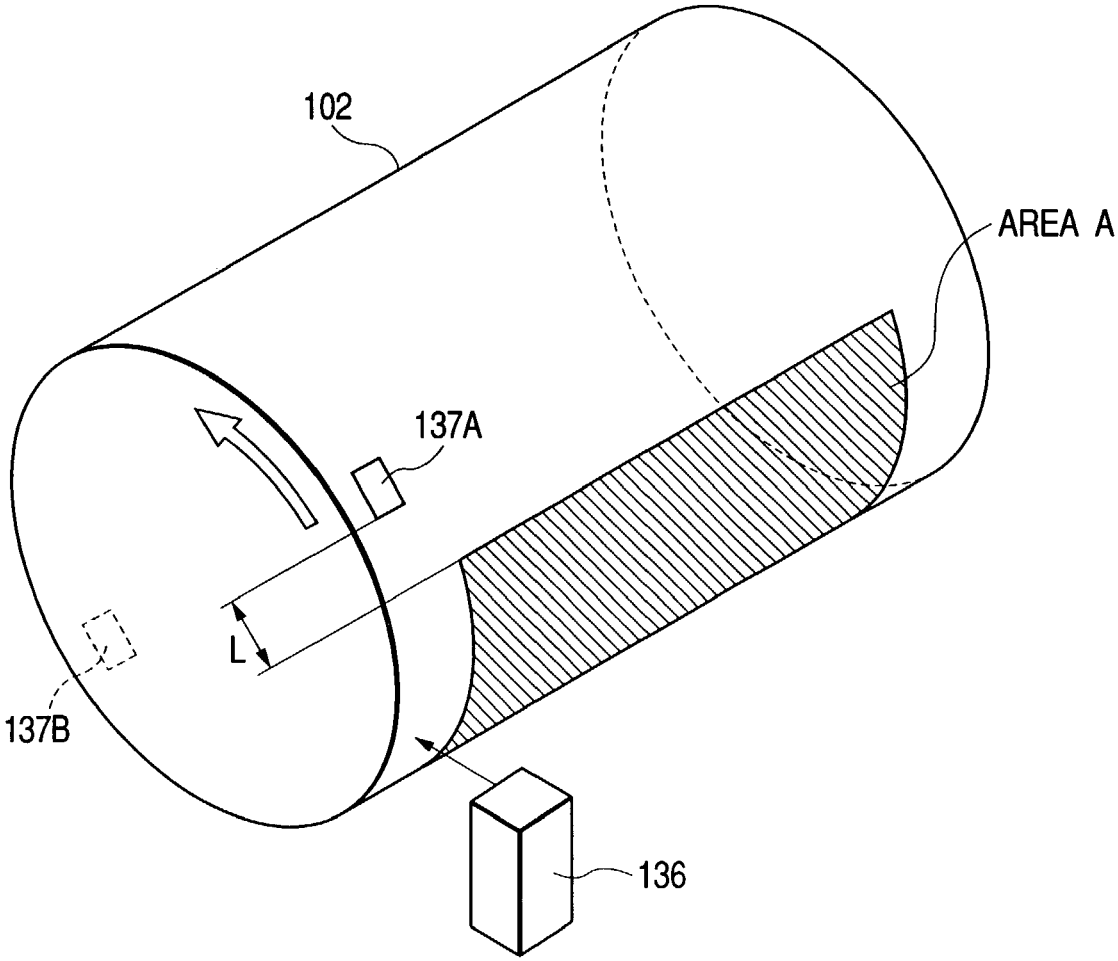
FIG. 9 is a view for explaining a relation between a reflection tape of an intermediate transfer belt of the image forming apparatus and a toner image.

FIG. 9 is a view for explaining a relation between the toner image and the reflection tape or the like. Reference numeral 102 represents an intermediate transfer belt, and reference numerals 137A and 137B represent markings such as reflection tapes provided on an outer peripheral end of the intermediate transfer belt 102. In this embodiment, a peripheral length of the intermediate transfer belt 102 is set to 502.65 mm ($=160\times\pi$ mm), and this length is equal to a length of a maximum image size of 432 mm plus a length corresponding to time capable of rotating the developing devices (113Y to 113K in FIG. 8).

When a length of an image to be formed and/or a recording sheet is equal to or smaller than a letter size (216 mm) ("small size (A4 or letter)", hereinafter), images for two sheets are formed on the intermediate transfer belt 102, and when the length is equal to or larger than that (large size (A3, B4 or legal, hereinafter), image for one sheet is formed. When toner image of two sheets is to be formed on the periphery of the intermediate transfer belt 102, a reference signal of a first sheet (area A, hereinafter) is obtained by 137A, and a reference signal of a second sheet (area B, hereinafter) is obtained by 137B. That is, when there are the area A and area B on the intermediate transfer belt 102 and an image is formed on a recording sheet of small size (A4 or letter), an image of one page is transferred in the area A and an image of another one page is transferred in the area B. With this, image of total two pages can be held on the intermediate transfer belt 102. In the case of a large size (A3, B4 or legal), a toner image is formed using the 137A as a reference. That is, when an image is formed on a recording sheet of large size (A3, B4 or legal), an image of one page is formed such as to be spread over the areas A and B.

Figure 10:
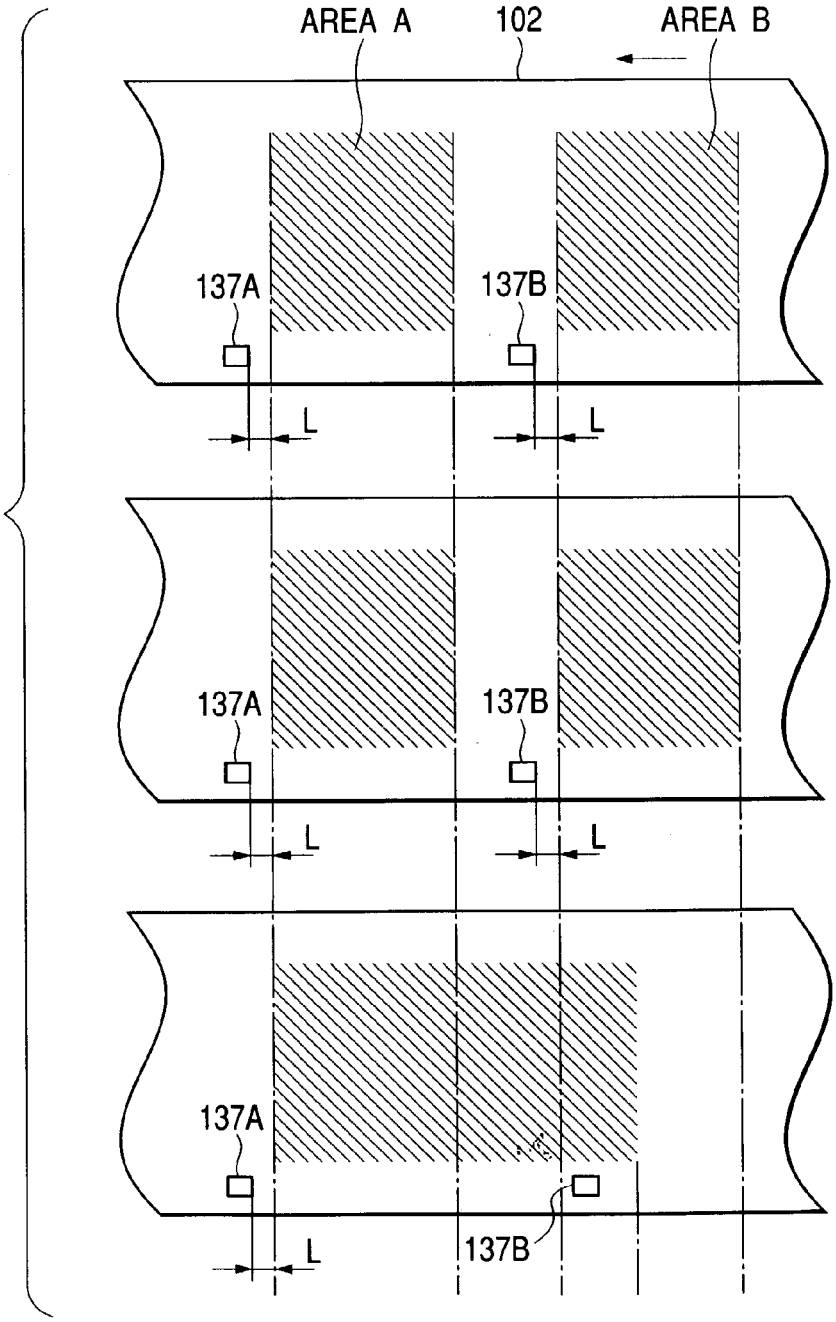
FIG. 10 is a view for explaining a state in which the intermediate transfer belt is developed and vertically arranged for each image formation.

FIG. 10 is a view for explaining a state in which the intermediate transfer belt 102 is spread and arranged in time sequence. As an example, FIG. 10 shows a case in which four sheets of small size (A4 or letter) and one sheet of large size (A3, B4 or legal) are formed as images.

As shown in FIG. 10, in the case of small size (A4 or letter), a toner image is formed at a position away from the markings 137A and 137B by distances L, and in the case of large size (A3, B4 or legal), a toner image is formed at a position away from the marking 137A by a distance L.

Next, control of the secondary transfer roller 121 for transferring an image of the intermediate transfer belt 102 on a recording sheet will be explained.

Figure 11:
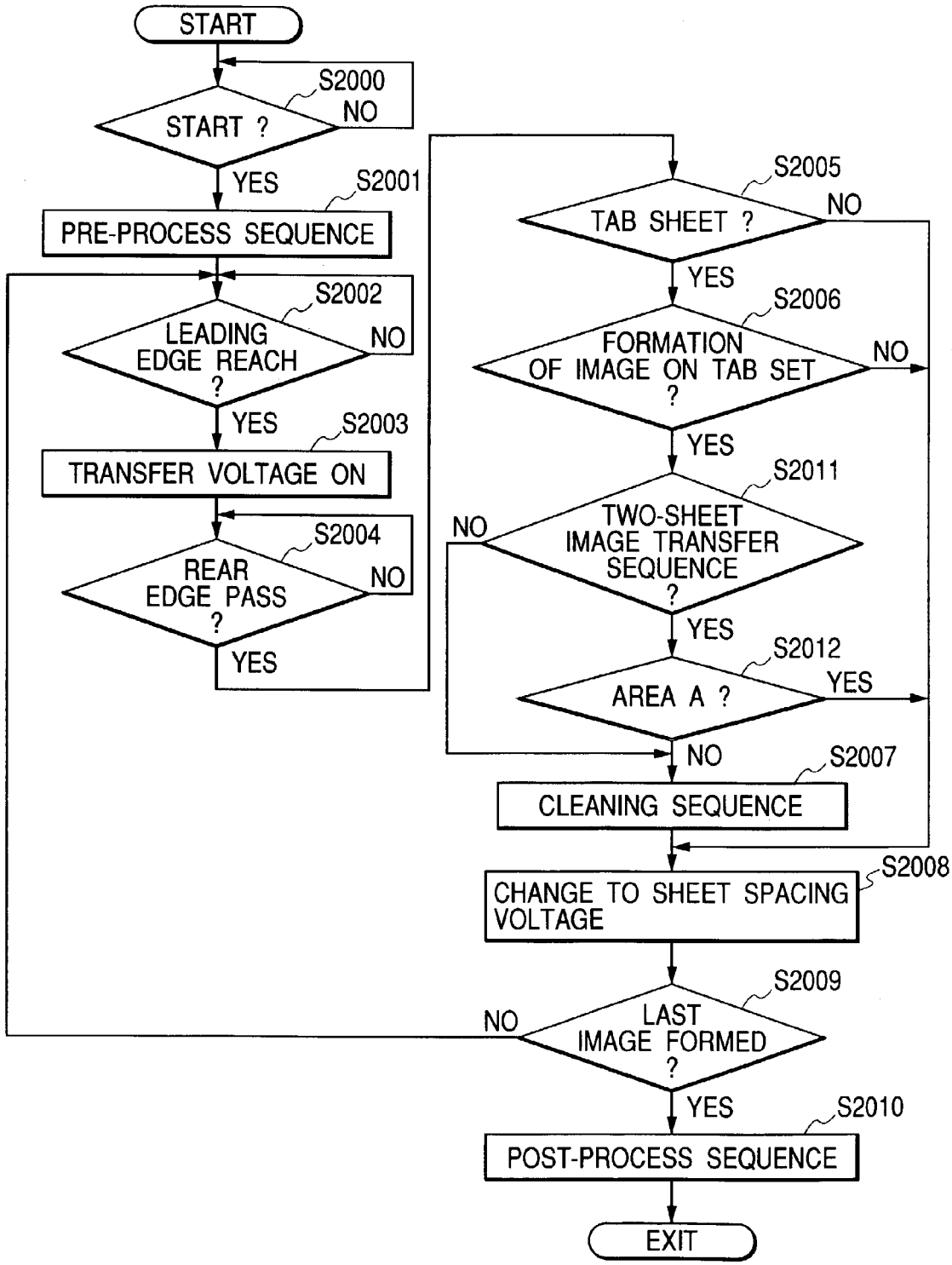
FIG. 11 is a flowchart for explaining control of the secondary transfer roller of the image forming apparatus.

FIG. 11 shows a flowchart for explaining the control of the secondary transfer roller 121 for transferring an image of the intermediate transfer belt 102 on a recording sheet. The processing shown here is called at regular time intervals or if necessary by main sequence. A program for executing this flowchart is stored in the ROM 205, and is read out and executed by the CPU 201.

First, in step S2000, it is judged whether or not an image forming operation is started. If it is judged that the image forming operation is not started in step S2000 (S2000: No), the procedure is returned to step S2000 to wait until the image forming operation is started. If it is judged that the image forming operation is started in step S2000 (S2000: Yes), the procedure is proceeded to step S2001.

In step S2001, a pre-processing for the image forming operation is carried out. This pre-processing establishes a state in which an image can be transferred to a recording sheet by the secondary transfer roller 121. For example, predetermined voltage is applied to the secondary transfer roller 121, flowing current is measured to determine transfer voltage, cleaning sequence of the secondary transfer roller 121 which will be described later is executed, and standby voltage before the image is transferred is output. Then, the procedure is proceeded to step S2002.

In step S2002, it is judged whether or not an image formed by the photosensitive drum 101 and placed on the intermediate transfer belt 102 by the transfer device 110 has reached a position of the secondary transfer roller 121. In step S2002, if it is judged that the image on the intermediate transfer belt 102 has not yet reached the position of the secondary transfer roller 121 (step S2002: No), the procedure is returned to step S2002 to wait until the image reaches. At that time, as already explained, the intermediate transfer belt 102 is rotated four times, and it is judged whether or not a top of the four color image transferred to the intermediate transfer belt 102 by the transfer device 110 has reached the position of the secondary transfer roller 121. If it is judged that the images has reached the position of the secondary transfer roller 121 in step S2002 (S2002: Yes), the procedure is proceeded to step S2003.

In step S2003, transfer voltage is output as voltage of the secondary transfer roller 121 for transferring an image from the intermediate transfer belt 102 to a recording sheet. When it is judged whether or not the image has reached the position of the secondary transfer roller 121 in step S2002, it is possible to fast judge the response time of the transfer voltage output in step S2003. After the transfer voltage of the secondary transfer roller 121 is brought into image transfer voltage in step S2003, procedure is proceeded to step S2004.

In step S2004, it is judged whether or not an image length transferred to the intermediate transfer belt 102 has passed through the secondary transfer roller 121. If it is judged that the length has not yet passed in step S2004 (S2004: No), the procedure is returned to step S2004 to wait until the length passes. If it is judged that the length has passed in step S2004 (S2004: Yes), the procedure is proceeded to step S2005.

In step S2005, it is judged whether or not the recording sheet on which the image was transferred by the secondary transfer roller 121 is a tab sheet. If it is judged that the recording sheet is not the tab sheet in step S2005 (S2005: No), the procedure is proceeded to step S2008. If it is judged that the recording sheet is the tab sheet in step S2005 (S2005: Yes), the procedure is proceeded to step S2006.

In step S2006, it is judged whether or not it was set to form the image on a tab portion of the tab sheet on the basis of the setting of the tab sheet insert mode or the tab sheet preparing mode explained in FIGS. 3A to 3C and the setting of the shift amount of the image as explained in FIGS. 4A to 4C, the size of the original image and the size of the tab sheet. If it is judged that it was set not to form the image on the tab portion in step S2006 (S2006: No), the procedure is proceeded to step S2008. If it was set to form the image on the tab portion in step S2006 (S2006: Yes), the procedure is proceeded to step S2011.

In step S2011, it is judged whether or not the image transferred to the recording sheet is small size (A4 or letter) image and whether or not there is employed a mode in which two sheets of images are transferred to the intermediate transfer belt 102 to form a color image. If it is judged that the mode in which two sheets of color image are transferred to the intermediate transfer belt 102 is not employed in step S2011 (S2011: No), the procedure is proceeded to step S2007. If it is judged that the mode in which two sheets of color image are transferred to the intermediate transfer belt 102 is employed in step S2011 (S2011: Yes), the procedure is proceeded to step S2012.

In step S2012, it is judged whether or not the transferred image is an image in an area A on the intermediate transfer belt 102. If it is judged that it is an image in the area A (S2012: Yes), the procedure is proceeded to step S2008, and since the next image (image in the area B) is already processed at the same interval, the cleaning processing is not carried out. If it is judged that it is the image in area A in step S2012, (S2012: No), the procedure is proceeded to step S2007.

In step S2007, cleaning processing of the secondary transfer roller 121 is carried out. In the cleaning processing of the secondary transfer roller 121, voltage having polarity opposite from that when the image of the intermediate transfer belt 102 is transferred to the recording sheet is applied to the secondary transfer roller 121 and in this state, if it is held for a predetermined time (e.g., time required for the secondary transfer roller 121 to rotate one revolution), toner is transferred from the secondary transfer roller 121 to the intermediate transfer belt 102. Toner adhered to the intermediate transfer belt 102 is cleaned by the belt cleaner 122. A time period during which voltage having the opposite polarity is applied to the secondary transfer roller 121 may be changed in accordance with a length of the image to be placed on the tab portion, i.e., the shift amount explained in FIGS. 4A to 4C, the size of the original and the size of the tab sheet.

In a case the cleaning processing of the secondary transfer roller 121 is carried out, i.e., when an image is formed on a tab portion of the tab sheet, a space in which the cleaning processing can be carried out is left between an image to be formed on the tab sheet and an image to be formed on the recording sheet which is supplied after the tab sheet, and the next image is formed. In other words, in a case the cleaning processing of the secondary transfer roller 121 is carried out, when an image is formed on a tab portion of the tab sheet, an enough distance for carrying out the cleaning processing is left between a rear end of the tab sheet and a leading end of a recording sheet which is supplied after the tab sheet, and a next recording sheet is supplied.

If the cleaning processing of the secondary transfer roller 121 is completed in step S2007, the procedure is proceeded to step S2008.

In step S2008, voltage of the secondary transfer roller 121 is changed to voltage for between sheets, and the procedure is proceeded to step S2009. Here, the voltage for sheet spacing may be voltage when an image is transferred from the intermediate transfer belt 102 to the recording sheet.

In step S2009, it is judged whether or not an image transferred to the recording sheet is a final image of image forming. If it is judged that the image is not final in step S2009 (S2009: No), the processing is returned to step S2002 where the following steps are repeated. If it is judged that the image is final (S2009: Yes), the procedure is proceeded to step S2010.

In step S2010, post-processing for completing the image forming operation is carried out. In this post-processing, the cleaning sequence of the secondary transfer roller 121 is carried out, voltage of the secondary transfer roller 121 is turned off and the flow is proceeded to the exit.

In this embodiment, control is switched, when the sheet is a tab sheet and further an image is formed on the tab sheet. But the same effect can be obtained even if the control is switched when the sheet is the tab sheet.

Although the procedure is proceeded to step S2011 if it is judged that it is a tab sheet in step S2005 and that an image is set to be formed on the tab portion, if it is judged that it is a tab sheet in step S2005, the procedure may be proceeded to step S2011 (without through step S2006), and if it is judged that it is not the tab sheet, the procedure may be proceeded to step S2008. In this case, the same effect can be obtained with easier judgment.

Further, in this embodiment, when images are formed on tab sheets, a distance between images is set larger than a distance between images when the images are formed on recording sheets other than tab sheets, a distance between recording sheets is set larger than a distance between recording sheets when the images are formed on the recording sheets other than the tab sheets, and the cleaning operation is carried out. However, the present invention is not limited to the tab sheets, and the invention can also be applied to a case in which an image is formed on a special sheet such as a pre-punch sheet which is previously formed with a hole and a non-rectangular sheet other than a rectangular sheet. That is, the present invention also includes such a structure that when images are formed on special sheets such as the pre-punch sheets or non-rectangular sheets, a distance between images is set larger than a distance between images when the images are formed on recording sheets other than tab sheets, a distance between recording sheets is set larger than a distance between recording sheets when the images are formed on the recording sheets other than the tab sheets and the cleaning operation is carried out.

As explained above, when a mechanism in which an image is transferred by contacting with a recording sheet such as a transferring roller is employed to form an image on a tab sheet, costs are not increased unlike the image mask processing in which the cleaning sequence of the transferring roller is carried out to process the image in accordance with a tab shape, and it is possible to provide an image forming apparatus capable of preventing from being contaminated a back surface of a recording sheet on which an image is to be formed next.

(Third Embodiment)

An image forming apparatus of a third embodiment of the present invention has the same structure as that explained using FIGS. 8 to 10 and 2 to 6.

Next, control for image forming operation of this embodiment will be explained.

Figure 12:
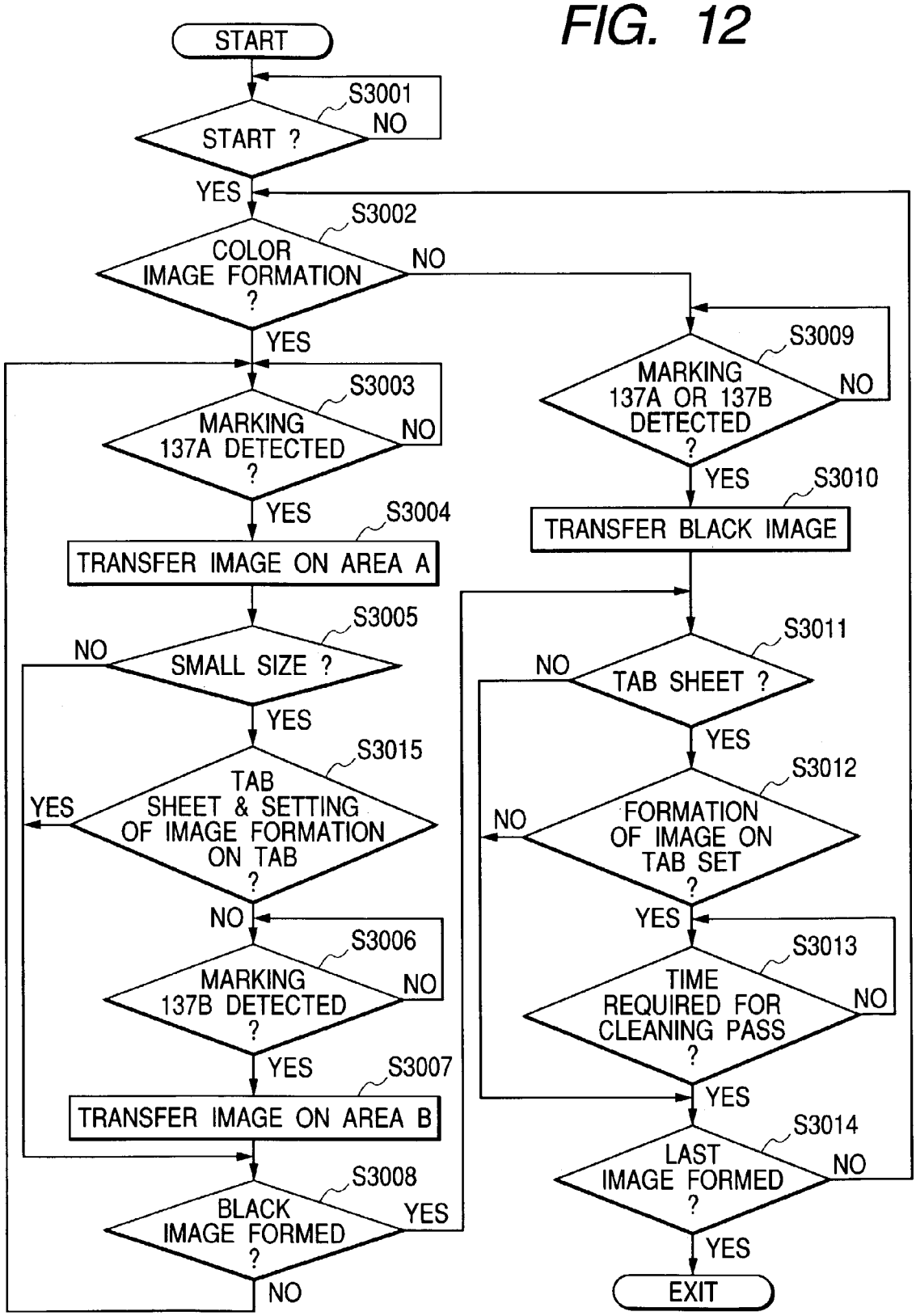
FIG. 12 is a flowchart for explaining image forming control steps of an image forming apparatus of a third embodiment of the present invention.

FIG. 12 is a flowchart for explaining the control step for the image forming operation of the image forming apparatus of this embodiment. The processing is called at regular time intervals or if necessary by main sequence. A program for executing this flowchart is stored in the ROM 205, and is read out and executed by the CPU 201.

First, in step S3001, it is judged whether or not an image forming operation is started. If it is judged that the image forming operation is not started (S3001: No), the procedure is returned to step S3001 to wait until the image forming operation is started. If it is judged that the image forming operation is started in step S3001 (S3001: Yes), the procedure is proceeded to step S3002.

In step S3002, it is judged whether or not an image to be formed is a color image. If it is judged that the image to be formed is the color image (S3002: Yes), the procedure is proceeded to step S3003.

In step S3003, it is judged whether or not the marking 137A is detected by the sensor 136, and if it is judged that the marking has not yet detected (S3003: No), the procedure is returned to step S3003 to wait until the marking is detected. If it is judged that the marking 137A is detected in step S3003 (S3003: Yes), the procedure is proceeded to step S3004.

In step S3004, an image of one color is formed in the area A by an I-top signal based on a signal of the sensor 136, and this image is transferred to the intermediate transfer belt 102. Then, the procedure is proceeded to step S3005, and it is judged whether or not the recording sheet size is small size (A4 or letter). If it is judged that the size is not small size (A4 or letter) in step S3005 (S3005: No), the procedure is proceeded to step S3008. Here, when it is judged whether or not the size is small size (A4 or letter), in the case of tab sheet, this judgment is made with size from which the tab portion is removed. If it is judged that the size is small size (A4 or letter) in step S3005, the procedure is proceeded to step S3015.

In step S3015, it is judged whether or not the recording sheet is a tab sheet and furthermore it is set to form an image on a tab portion. Here, whether or not it is set to form the image on a tab portion of the tab sheet is judged on the basis of the setting of the tab sheet insert mode or the tab sheet preparing mode explained in FIGS. 3A to 3C and the setting of the shift amount of the image as explained in FIGS. 4A to 4C, the size of the original image and the size of the tab sheet. If it is judged that the sheet is the tab sheet and further it is set to form the image on the tab portion in step S3015 (S3015: Yes), the procedure is proceeded to step S3008. That is, if it is judged that it is set to form the image on the tab portion of the tab sheet in step S3015, the image is transferred only to the area A of the intermediate transfer belt 102, and the image is not transferred to the area B, so that the intermediate transfer belt 102 is prohibited to hold images of plurality of pages.

On the other hand, it is judged that the sheet is not the tab sheet and it is set not to form the image on the tab portion (S3015: No), the procedure is proceeded to step S3006.

In step S3006, it is judged whether or not the marking 137B has been detected by the sensor 136, and if the marking 137B has not yet been detected (S3006: No), the procedure is returned to step S3006 to wait until the marking is detected. If the marking 137B is detected in step S3006 (S3006: Yes), the procedure is proceeded to step S3007.

In step S3007, an image of one color is formed in the area B by the I-top signal based on a signal of the sensor 136, and this image is transferred to the intermediate transfer belt 102. That is, if it is judged that a mode for forming an image on a recording sheet other than a tab sheet, or a mode for not forming an image on a tab portion of a tab sheet is employed, the image is transferred to the area A and area B of the intermediate transfer belt 102, thereby allowing the intermediate transfer belt 102 to hold the image of plurality of pages.

Then, the procedure is proceeded to step S3008, and it is judged whether or not the color which forms the image is K (black). If it is judged that the color is not black in step S3008 (S3008: No), the procedure is returned to step S3003. If it is judged that the color is black in step S3008 (S3008: Yes), since the image transfer of one page (four colors) is completed, the image is transferred to the recording sheet from the intermediate transfer belt 102 by the secondary transfer roller 121, and the procedure is proceeded to step S3011 as will be explained later using FIG. 7.

In step S3011, it is judged whether or not the recording sheet on which the image was transferred is a tab sheet. If it is judged that the recording sheet is not a tab sheet (S3011: No), the procedure is proceeded to step S3014, and if it is judged that the recording sheet is a tab sheet (S3011: Yes), the procedure is proceeded to step S3012.

In step S3012, it is judged whether or not it is set to form an image on a tab portion of a tab sheet. If it is judged that it is set not to form the image on the tab portion in step S3012 (S3012: No), the procedure is proceeded to step S3014, and if it is judged that it is set to form the image on the tab portion in step S3012 (S3012: Yes), the procedure is proceeded to step S3013.

In step S3013, it is judged whether or not time required for executing the cleaning processing of the secondary transfer roller 121 (time required for rotating the secondary transfer roller 121 at least one revolution) is elapsed after the image is transferred to the tab sheet from the intermediate transfer belt 102. If it is judged that the time required for the cleaning processing is not elapsed in step S3013, (S3013: No), the procedure is returned to step S3013 to wait until the time is elapsed. If it is judged that the time required for the cleaning processing is elapsed in step S3013, (S3013: Yes), the procedure is proceeded to step S3014.

In step S3014, it is judged whether or not an image transferred to the recording sheet is a final image of image forming. If it is judged that the image is not final in step S3014 (S3014: No), the processing is returned to step S3002 where the following steps are repeated. If it is judged that the image is final in step S3014 (S3014: Yes), the flow is proceeded to the exit.

If it is judged that the image is not the color image in step S3002 (S3002: No), the procedure is proceeded to step S3009. In step S3009, it is judged whether or not the marking 137A or 137B is detected by the sensor 136. If it is judged that the marking 137A or 137B is not detected in step S3009 (S3009: No), the procedure is returned to step S3009 to wait until the markings are detected. If it is judged that the marking 137A or 137B is detected in step S3009 (S3009: Yes), the procedure is proceeded to step S3010.

In step S3010, a black image is formed by the I-top signal based on a signal of the sensor 136, the image is transferred to the intermediate transfer belt 102, the image is transferred from the intermediate transfer belt 102 to the recording sheet by the secondary transfer roller 121 as described above, and the procedure is proceeded to step S3011.

Next, control of the secondary transfer roller 121 possessed by the image forming apparatus of the embodiment will be explained using FIG. 7. This FIG. 7 is the same as the previous embodiment, but the explanation will be made in accordance with the present embodiment. A program for executing this flowchart is stored in the ROM 205, and is read out and executed by the CPU 201.

First, in step S1000, it is judged whether or not an image forming operation is started. If it is judged that the image forming operation is not started in step S1000 (S1000: No), the procedure is returned to step S1000 to wait until the image forming operation is started. If it is judged that the image forming operation is started in step S1000 (S1000: Yes), the procedure is proceeded to step S1001.

In step S1001, a pre-processing for the image forming operation is carried out. This pre-processing establishes a state in which an image can be transferred to a recording sheet by the secondary transfer roller 121. For example, predetermined voltage is applied to the secondary transfer roller 121, flowing current is measured to determine transfer voltage, cleaning sequence of the secondary transfer roller 121 which will be described later is executed, and standby voltage before the image is transferred is output. Then, the procedure is proceeded to step S1002.

In step S1002, it is judged whether or not an image formed by the photosensitive member 101 and placed on the intermediate transfer belt 102 by the primary transfer reached a position of the secondary transfer roller 121. At that time, in formation of a color image, as already explained, the intermediate transfer belt 102 is rotated four times, and it is judged whether or not a top of an image of which fourth color image is transferred to the intermediate transfer belt 102 by the transfer device 110 has reached the position of the secondary transfer roller 121. If it is judged that the images on the intermediate transfer belt 102 has not yet reached the position of the secondary transfer roller 121 in step S1002 (S1002: No), the procedure is proceeded to step S1003. If it is judged that the images has reached the position of the secondary transfer roller 121 in step S1002 (S1002: Yes), the procedure is proceeded to step S1003.

In step S1003, transfer voltage is output as voltage of the secondary transfer roller 121 for transferring an image from the intermediate transfer belt 102 to a recording sheet. When it is judged whether or not the image has reached the position of the secondary transfer roller 121 in step S1002, it is possible to fast judge the response time of the transfer voltage output in step S1003. After the transfer voltage of the secondary transfer roller 121 is brought into image transfer voltage in step S1003, procedure is proceeded to step S1004.

In step S1004, it is judged whether or not an image length transferred to the intermediate transfer belt 102 has passed through the secondary transfer roller 121. If it is judged that the length has not yet passed in step S1004 (S1004: No), the procedure is returned to step S1004 to wait until the length passes. If it is judged that the length has passed in step S1004 (S1004: Yes), the procedure is proceeded to step S1005.

In step S1005, it is judged whether or not the recording sheet on which the image was transferred by the secondary transfer roller 121 is a tab sheet. If it is judged that the recording sheet is not the tab sheet in step S1005 (S1005: No), the procedure is proceeded to step S1008. If it is judged that the recording sheet is the tab sheet in step S1005 (S1005: Yes), the procedure is proceeded to step S1006.

In step S1006, it is judged whether or not it was set to form the image on a tab portion of the tab sheet on the basis of the setting of the tab sheet insert mode or the tab sheet preparing mode explained in FIGS. 3A to 3C and the setting of the shift amount of the image as explained in FIGS. 4A to 4C, the size of the original image and the size of the tab sheet. If it is judged that it was set not to form the image on the tab portion in step S1006 (S1006: No), the procedure is proceeded to step S1008. If it was set to form the image on the tab portion in step S1006 (S1006: Yes), the procedure is proceeded to step S1007.

In step S1007, cleaning processing of the secondary transfer roller 121 is carried out. In the cleaning processing of the secondary transfer roller 121, voltage having polarity opposite from that when the image of the intermediate transfer belt 102 is transferred to the recording sheet is applied to the secondary transfer roller 121 and in this state, if it is held for a predetermined time (e.g., time required for the secondary transfer roller 121 to rotate at least one revolution), toner is transferred from the secondary transfer roller 121 to the intermediate transfer belt 102. Toner adhered to the intermediate transfer belt 102 is cleaned by the belt cleaner 22.

A time period during which voltage having the opposite polarity is applied to the secondary transfer roller 36 may be changed in accordance with a length of the image to be placed on the tab portion, i.e., the shift amount explained in FIGS. 4A to 4C, the size of the original and the size of the tab sheet.

In a case the cleaning processing of the secondary transfer roller 121 is carried out, when an image is formed on a tab portion of the tab sheet, the image is transferred only to the area A of the intermediate transfer belt 102 and not transferred to the area B so that the intermediate transfer belt 102 is prohibited to hold the image of a plurality of pages. In other words, in a case the cleaning processing of the secondary transfer roller 121 is carried out, when an image is formed on a tab portion of the tab sheet, an enough distance for carrying out the cleaning processing is left between a rear end of the tab sheet and a leading end of a recording sheet which is supplied after the tab sheet, and a next recording sheet is supplied.

If the cleaning processing of the secondary transfer roller 121 is completed in step S1007, the procedure is proceeded to step S1008.

In step S1008, voltage of the secondary transfer roller 121 is changed to voltage for sheet sparing, and the procedure is proceeded to step S1009. Here, the voltage between the sheets may be voltage when an image is transferred from the intermediate transfer belt 102 to the recording sheet.

In step S1009, it is judged whether or not an image transferred to the recording sheet is a final image of image forming. If it is judged that the image is not final (S1009: No), the processing is returned to step S1002 where the following steps are repeated. If it is judged that the image is final (S1009: Yes), the procedure is proceeded to step S1010.

In step S1010, post-processing for completing the image forming operation is carried out. In this post-processing, the cleaning sequence of the secondary transfer roller 121 is carried out, voltage of the secondary transfer roller 121 is turned off and the flow is proceeded to the exit.

In the above-described control operation, although the procedure is proceeded to step S1007 if it is judged that it is set to form the image on the tab portion in step S1006, it is also possible to control such that the procedure is proceeded to step S1007 if it is judged that the sheet is a tab sheet irrespective whether or not it is set to form the image on the tab portion, and the procedure is proceeded to step S1008 if it is judged the sheet is not the tab sheet.

In this embodiment, control is switched, when the sheet is a tab sheet and further an image is formed on the tab sheet. But the same effect can be obtained even if the control is switched when the sheet is the tab sheet.

Although the procedure is proceeded to step S1007 if it is judged that it is a tab sheet in step S1005 and that an image is set to be formed on the tab portion, if it is judged that it is a tab sheet in step S1005, the procedure may be proceeded to step S1007 (without through step S1006), and if it is judged that it is not the tab sheet, the procedure may be proceeded to step S1008. In this case, the same effect can be obtained with easier judgment.

Further, in this embodiment, when images are formed on tab sheets, a distance between images is set larger than a distance between images when the images are formed on recording sheets other than tab sheets, a distance between recording sheets is set larger than a distance between recording sheets when the images are formed on the recording sheets other than the tab sheets, and the cleaning operation is carried out. However, the present invention is not limited to the tab sheets, and the invention can also be applied to a case in which an image is formed on a special sheet such as a pre-punch sheet which is previously formed with a hole and a non-rectangular sheet other than a rectangular sheet. That is, the present invention also includes such a structure that when images are formed on special sheets such as the pre-punch sheets or non-rectangular sheets, a distance between images is set larger than a distance between images when the images are formed on recording sheets other than tab sheets, a distance between recording sheets is set larger than a distance between recording sheets when the images are formed on the recording sheets other than the tab sheets and the cleaning operation is carried out.

(Fourth Embodiment)

Next, an image forming apparatus of a fourth embodiment of the present invention will be explained. The image forming apparatus of the fourth embodiment of the invention has the same structure as that explained using FIGS. 8 to 10 and FIGS. 2 to 6. The fourth embodiment has the same arrangement as explained using FIG. 7 in the third embodiment.

Figure 13A:
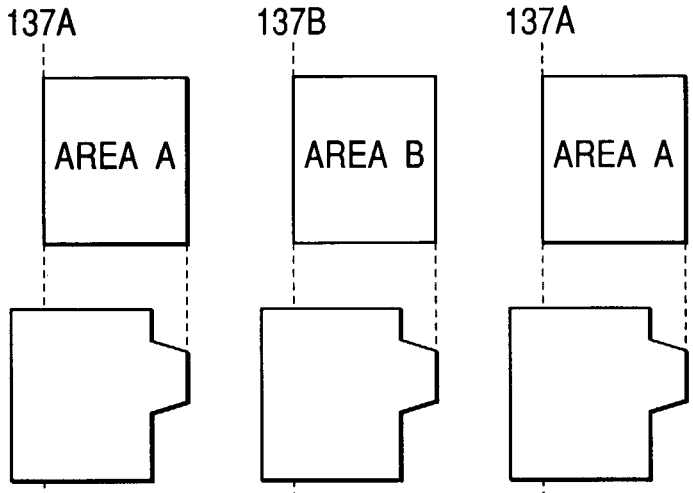
FIGS. 13A, 13B and 13C are views for explaining a relation of original images and print positions of tab sheets in the image forming apparatus.
Figure 13B:
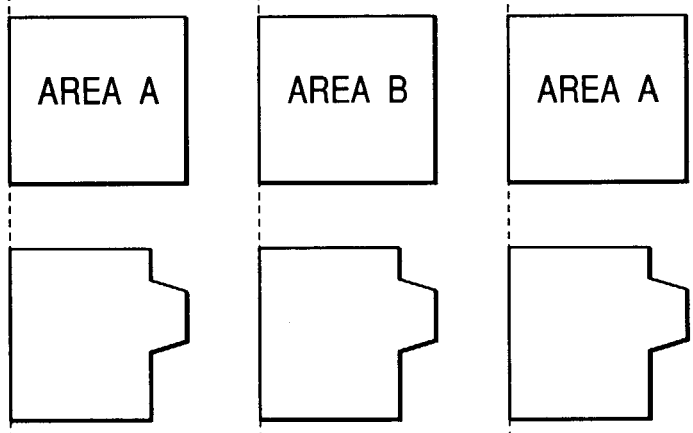
Figure 13C:
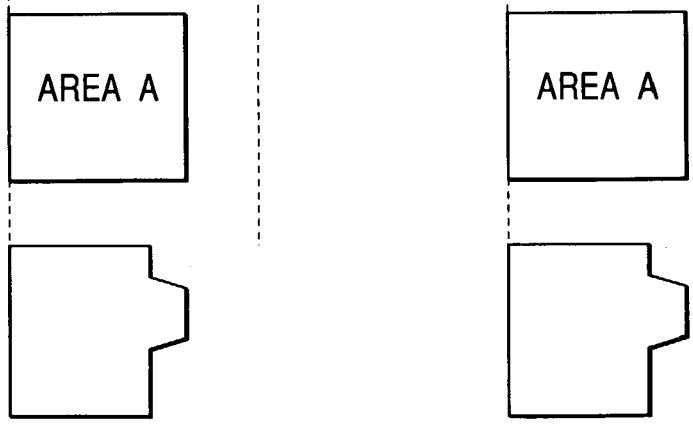

FIGS. 13A to 13C are views for explaining a relation between an original image of the image forming apparatus of the embodiment and a print position of a tab sheet. The original image in FIG. 13A has the same size as that of a tab sheet from which a tab portion is removed. When an image formed on the intermediate transfer belt 102 is transferred to the recording sheet, a tab sheet is precedently conveyed to the secondary transfer roller 121 as compared with a case of a normal recording sheet. In this case, a distance between the area B and the area A of the image formed on the intermediate transfer belt 102 (time required for switching the developing device 133) is the same as that of a normal recording sheet. In the case of FIG. 13B, the original image has a size including the tab portion of the tab sheet. In this case, if the image is formed on the intermediate transfer belt 102 as in the same manner as that of a case in which there is no tab portion, an image between the areas B and A becomes narrow, and the developing device 133 can not be switched (switch from cyan to magenta for example) in time. Thereupon, the image is formed by the I-top signal generated by the 137A as shown in FIG. 13C.

Next, a control method of the image forming operation of this embodiment will be explained.

Figure 14:
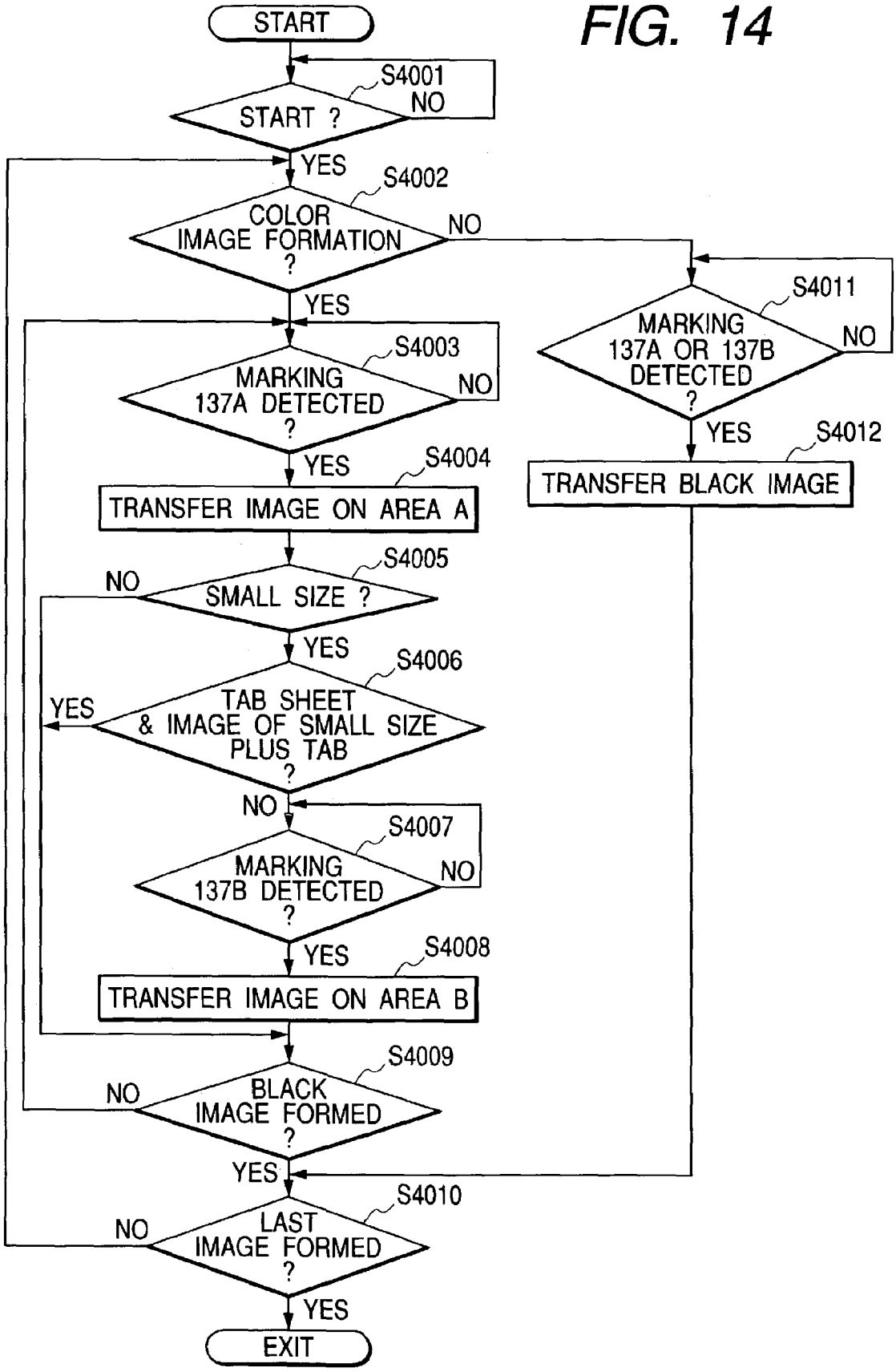
FIG. 14 is a flowchart for explaining control of image formation in an image forming apparatus of a fourth embodiment of the present invention.

FIG. 14 is a flowchart for explaining the control method of the image forming operation of this embodiment. The processing is called at regular time intervals or if necessary by main sequence. A program for executing this flowchart is stored in the ROM 205, and is read out and executed by the CPU 201.

First, in step S4001, it is judged whether or not an image forming operation is started. If it is judged that the image forming operation is not started in step S4001 (S4001: No), the procedure is returned to step S4001 to wait until the image forming operation is started. If it is judged that the image forming operation is started in step S4001 (S4001: Yes), the procedure is proceeded to step S4002.

In step S400, it is judged whether or not an image to be formed is a color image. If it is judged that the image is the color image in step S4002 (S4002: Yes), the procedure is proceeded to step S4003.

In step S4003, it is judged whether or not a marking 137A is detected by the sensor 136, and if it is judged that the marking has not yet detected (S4003: No), the procedure is returned to step S4003 to wait until the marking is detected. If it is judged that the marking 137A is detected (S4003: Yes), the procedure is proceeded to step S4004.

In step S4004, an image of one color is formed in the area A by an I-top signal based on a signal of the sensor 136, and this image is transferred to the intermediate transfer belt 102. Then, the procedure is proceeded to step S4005, and it is judged whether or not the recording sheet size is small size (A4 or letter).

If it is judged that the size is not small size (A4 or letter) in step S4005 (S4005: No), the procedure is proceeded to step S4009. Here, when it is judged whether or not the size is small size (A4 or letter), in the case of tab sheet, this judgment is made with size from which the tab portion is removed. If it is judged that the size is small size (A4 or letter) in step S4005 (S4005: Yes), the procedure is proceeded to step S4006.

In step S4006, whether or not the recording sheet is a tab sheet and furthermore an image to be formed on the tab sheet has a length including a tab portion as shown in FIG. 13B, is judged. If it is judged that the recording sheet is the tab sheet and the image to be formed on the tab sheet has a length (a length obtained by adding a length of a small size sheet in its conveying direction to a length of a tab portion) including the tab portion as shown in FIG. 13B in step S4006, the procedure is proceeded to step S4009. If the recording sheet is not a tab sheet and the image to be formed on the tab sheet does not have a length including the tab portion as shown in FIG. 13B in step S4006, the procedure is proceeded to step S4007.

In step S4007, it is judged whether or not the marking 137B has been detected by the sensor 136, and if the marking 137B has not yet been detected in step S4007 (S4007: No), the procedure is returned to step S4007 to wait until the marking is detected. If the marking 137B is detected in step S4007 (S4007: Yes), the procedure is proceeded to step S4008.

In step S4008, an image of one color is formed in the area B by the I-top signal based on a signal of the sensor 136, and this image is transferred to the intermediate transfer belt 102. Then, the procedure is proceeded to step S4009, and it is judged whether or not the color which forms the image is K (black). If it is judged that the color is not black in step S4009 (S4009: No), the procedure is returned to step S4003. If it is judged that the color is black in step S4009 (S4009: Yes), since the image transfer of one page (four color images) is completed, the image is transferred to the recording sheet from the intermediate transfer belt 102 by the secondary transfer roller 121, and the procedure is proceeded to step S4010 as explained using FIG. 7.

In step S4010, it is judged whether or not an image transferred to the recording sheet is a final image of image forming. If it is judged that the image is not final in step S4010 (S4010: No), the processing is returned to step S4002 where the following steps are repeated. If it is judged that the image is final in step S4010 (S4010: Yes), the flow is proceeded to the exit.

If it is judged that the image is not the color image in step S4001 (S4001: No), the procedure is proceeded to step S4011.

In step S4011, it is judged whether or not the marking 137A or 137B is detected by the sensor 136. If it is judged that the marking 137A or 137B is not detected in step S4011 (S4011: No), the procedure is returned to step S4011 to wait until the marking is detected. If it is judged that the marking 137A or 137B is detected in step S4011 (S4011: Yes), the procedure is proceeded to step S4012.

In step S4012, a black image is formed by the I-top signal based on a signal of the sensor 136, the image is transferred to the intermediate transfer belt 102, the image is transferred from the intermediate transfer belt 102 to the recording sheet by the secondary transfer roller 121 as described above, and the procedure is proceeded to step S4010.

In this embodiment, control is switched when the sheet is a tab sheet and an image is formed on the tab sheet. But the same effect can be obtained even if the control is switched in the case of the tab sheet.

In the present embodiment, an image is transferred from the photosensitive body 101 to the intermediate transfer belt 102, and the intermediate transfer belt 102 is rotated four times, thereby forming a color image. However, the same effect can also be obtained by winding a recording sheet around a transfer drum, the transfer drum around which the recording sheet is attached is rotated four times, thereby directly transferring the image on the recording sheet from the photosensitive body 101.

Figure 15:
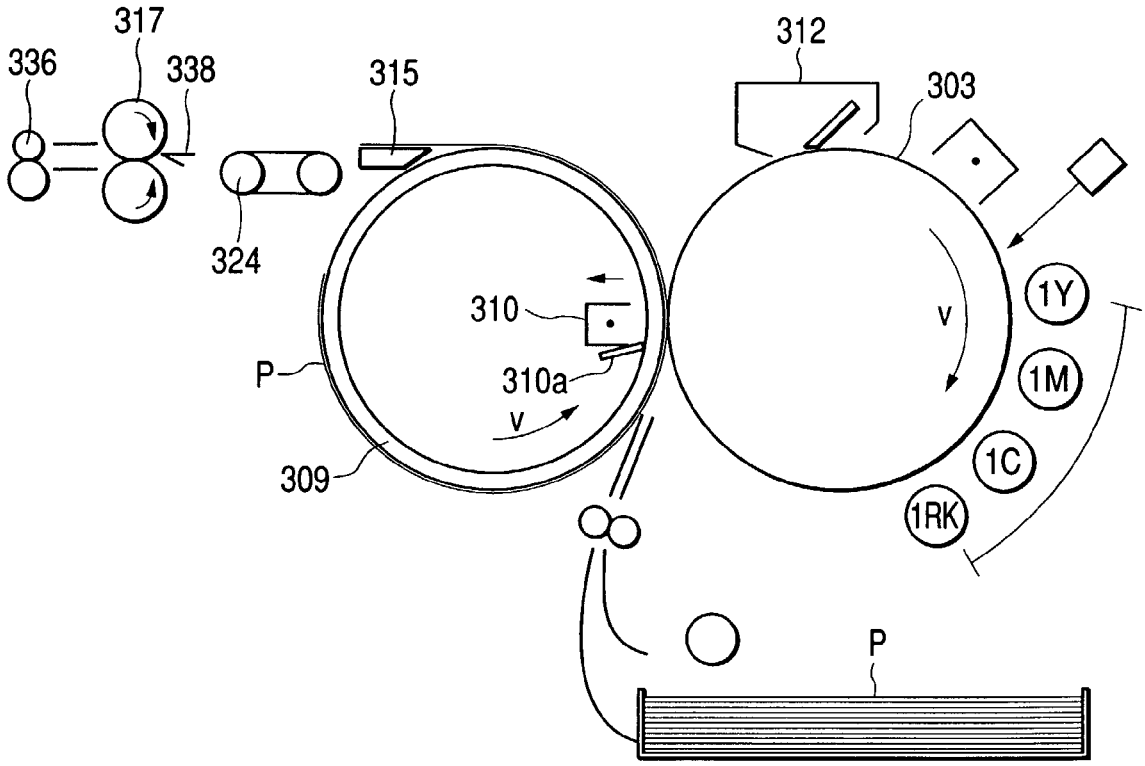
FIG. 15 is a view for explaining a structure of an image forming apparatus of another embodiment of the present invention.

A structure for winding a recording sheet around a transfer drum will be explained in accordance with FIG. 15. In FIG. 15, disposed around a photosensitive drum 303 which is a photosensitive body are a primary charger for charging a peripheral surface of the drum, developing devices 1Y, 1M, 1C and 1BK for visualizing an electrostatic latent image formed by exposure light image from exposure means, and a cleaning device 312 for collecting developer (toner) remained on a drum surface after the transfer of image. If the photosensitive drum 303 is rotated in a clockwise direction, the photosensitive drum 303 is charged by the primary charger. Then, an electrostatic latent image is formed by exposure light image including image information such as reflection light from a surface of an original (not shown) by exposure means such as a scanning optical device. The electrostatic latent image is developed in full color by the developing device and becomes a toner image. The developing apparatus includes developing devices 1Y, 1M, 1C and 1BK. The developing devices 1Y, 1M, 1C and 1BK respectively accommodate toner particles of yellow Y, magenta M, cyan C and black BK so that full color recording can be carried out by combination of toner particles having the colors. A transfer drum 309 which is a recording sheet carrier is in contact with a periphery of the photosensitive drum 303.

A transfer charger 310 for charging a recording sheet P which is a transfer medium with polarity opposite from the transferring image formed on the photosensitive drum 303 is provided in the transfer drum 309. The transfer drum 309 carries a plurality of recording sheets P therearound and transfers the toner image by the photosensitive drum 303. A sheet feed cassette in which the recording sheets P are mounted is provided upstream of the transfer drum 309 in a conveying direction of the recording sheets. The recording sheets P mounted in the sheet feed cassette are conveyed from its uppermost one along a guide member by a sheet-feed roller. The recording sheet P is conveyed to an image-transfer position in synchronization with the visualized image formed on the photosensitive drum 303. A separating pawl 315 for separating the recording sheet P from a peripheral surface of the transfer drum 309, a conveying device 324, a fixing entrance guide 338 and a fixing device for fixing the transferring image of the recording sheet P are provided downstream of the transfer drum 309.

Toner adhering to the transfer drum 309 is cleaned in the following manner. Bias opposite from that when an image is transferred from the photosensitive drum 303 to a recording sheet is applied to the transfer charger 310 and the photosensitive drum 303, thereby moving the toner adhering to the transfer drum toward the photosensitive drum 303, and the cleaning device 312 cleans the toner adhering to the photosensitive drum 303.

Even if the recording sheet is wound around the transfer drum and the transfer drum around which the recording sheet is attached is rotated four times, and an image is directly transferred to the recording sheet from the photosensitive drum in this manner, the same effect as those of the previous embodiments can be obtained if the control is carried out in such a manner that it is judged that the sheet is a tab sheet or that the sheet is a tab sheet and there is an image on the tab sheet, only one sheet is attached to the transfer drum in accordance with a fact that the sheet is a tab sheet or that the sheet is a tab sheet and there is an image on the tab sheet, or a plurality of (two for example) recording sheets are wound around the transfer drum in accordance with a fact that the sheet is not a tab sheet or that the sheet is not a tab sheet and there is no image on the tab sheet.

In accordance with a fact that a length of an image to be formed on a tab recording sheet is longer than a length of the tab recording sheet from which a length of a tab is subtracted, if a plurality of (two for example) recording sheets are wound around the transfer drum, the same effect as those of the previous embodiments can be obtained.

As explained above, when a recording sheet is a tab recording sheet and an image is formed on a tab of the tab recording sheet, a first mode in which a toner image of a plurality of pages is transferred to the image-carrier is prohibited and thus, it is possible to provide time for cleaning a second transfer roller.

Further, when a recording sheet is a tab recording sheet, since the first mode in which the toner image of a plurality of pages is transferred to the image-carrier is prohibited, it is possible to provide time for cleaning the second transfer roller.

Further, when a length of an image to be formed on a tab recording sheet is longer than a length of the tab recording sheet from which a length of a tab is subtracted, since the first mode in which the toner image of a plurality of pages is transferred to the image-carrier is prohibited, it is possible to secure time for switching the developing device.

Furthermore, when a recording sheet is a tab recording sheet and an image is formed on a tab of the tab recording sheet, since a first grasping mode for grasping a plurality of recording sheets is prohibited, it is possible to provide time for cleaning the second transfer roller.

Moreover, when a recording sheet is a tab recording sheet, since the first grasping mode for grasping a plurality of recording sheets is prohibited, it is possible to provide time for cleaning the second transfer roller.

In addition, when a length of an image to be formed on a tab recording sheet is longer than a length of the tab recording sheet from which a length of a tab is subtracted, since a first mode for transferring a toner image of a plurality of pages to the image-carrier, it is possible to secure time for switching the developing device.

What is claimed is:

1. An image forming apparatus comprising:

an image forming device for forming an image on an image carrier;

a transferring device for transferring the image on the image carrier to recording sheets including a special sheet, which is any one of a tab sheet, a pre-punched sheet, and a non-rectangular sheet, and for performing a cleaning operation of said transferring device itself; and a controller for controlling said image forming device to carry out an image-forming operation, which forms an image on the recording sheet, wherein said controller controls said transferring device to perform the cleaning operation of said transferring device in response to transferring the image to the special sheet by said transferring device, and wherein said controller controls said transferring device so as not to perform the cleaning operation in response to transferring the image to a recording sheet other than the special sheet by said transferring device.

2. An image forming apparatus comprising:

an image forming device for forming images on an image carrier;

a transferring device for transferring the images on the image carrier to a recording sheet including a special sheet; and a controller for controlling a timing of an image formation on the image carrier such that the image carrier carries the images at predetermined distances between the images, wherein said controller prohibits said image forming device from forming a plurality of images on a circumference of the image carrier in response to an image formation on the special sheet.

3. An image forming apparatus comprising:

an image forming device for forming an image on a photosensitive member;

a first transfer device for transferring the image formed on said photosensitive member to an intermediate image carrier;

a second transfer device for transferring the image carried by said intermediate image carrier to a recording sheet; and a controller for controlling a distance for an image carried by said intermediate image carrier such that the image is carried on a circumference of said intermediate image carrier in response to image formation on a special sheet, which is any one of a tab sheet, a pre-punched sheet, and a non-rectangular sheet.

4. An image forming apparatus comprising:

an image carrier for carrying a developer;

an image forming device for forming an image on said image carrier;

a transferring device for transferring the developer carried by said image carrier to a recording sheet; and a controller, which selectively carries out a first control for controlling said transferring device such that the developer on said image carrier is transferred to the recording sheet, and a second control for controlling said transferring device such that a developer, which adheres to said transferring device, is transferred to said image carrier, wherein in a case where the developer is transferred to a special sheet, which is any one of a tab sheet, a pre-punched sheet, and a non-rectangular sheet, said controller controls said transfer device according to the first control and then, controls said transferring device according to the second control, and wherein said controller controls said transferring device so as not to perform the second control in a case where the developer is transferred to a recording sheet other than the special sheet.

5. An image forming apparatus according to claim 4, further comprising:

a cleaner for cleaning the developer on said image carrier.

6. An image forming apparatus according to claim 4, wherein said image carrier is a photosensitive body, the image forming apparatus further comprising:

a developing device for developing a latent image formed on said photosensitive body by the developer.

7. An image forming apparatus according to claim 4, wherein said image carrier is a photosensitive body.

8. An image forming apparatus comprising:

an image forming device for forming an image on a photosensitive body;

a developing device for developing a latent image formed on said photosensitive body by a developer;

a first transferring device for transferring the developer on said photosensitive body to an intermediate image carrier;

a second transferring device for transferring the developer on the intermediate image carrier to a recording sheet; and a controller, which selectively carries out a first control for controlling said second transferring device such that the developer carried on the intermediate image carrier is transferred to the recording sheet, and a second control for controlling said second transferring device such that a developer, which adheres to said second transferring device, is transferred to the intermediate image carrier, wherein in a case where the developer is transferred to a special sheet, said controller controls said second transferring device according to the first control and then, controls the second transferring device according to the second control.

9. An image forming apparatus according to claim 8, wherein said controller controls said second transferring device so as not to perform the second control in a case where the developer is transferred to a recording sheet other than the special sheet.

10. An image forming apparatus comprising:

an image forming device for forming an image on an image carrier;

a transferring device for transferring the image on the image carrier to a recording sheet including a special sheet, which is any one of a tab sheet, a pre-punched sheet, and a non-rectangular sheet, and for performing a cleaning operation of said transferring device itself;

a selecting device for selecting a first mode of conveying the special sheet to said image forming device and forming an image thereon, or a second mode of conveying the special sheet to said image forming device and not forming an image thereon; and a controller for controlling said image forming device to carry out an image-forming operation, which forms an image on the recording sheet, wherein when said selecting device selects the first mode, said controller controls said transferring device so that the cleaning operation of said transferring device is executed, while when said selecting device selects the second mode, said controller controls said transferring device so that the cleaning operation of said transferring device is not executed.

11. An image forming apparatus according to claim 10, further comprising:

a cleaner for cleaning developer on the image carrier.

12. An image forming apparatus according to claim 10, wherein the image carrier is a photosensitive body, the image forming apparatus further comprising:

a developing device for developing a latent image formed on said photosensitive body by the developer.

13. An image forming apparatus according to claim 10, wherein the image carrier is a photosensitive body.

14. An image forming apparatus comprising:

an image carrier for carrying a developer;

an image forming device for forming an image on said image carrier;

a transferring device for transferring the developer carried by said image carrier to a recording sheet including a special sheet, which is any one of a tab sheet, a pre-punched sheet, and a non-rectangular sheet, and for performing a cleaning operation of said transferring device itself;

a selecting device for selecting a first mode of conveying the special sheet to said image forming device and forming an image thereon, or a second mode of conveying the special sheet to said image forming device and not forming an image thereon; and a controller, which selectively carries out a first control for controlling said transferring device such that the developer on said image carrier is transferred to the recording sheet, and a second control for controlling said transferring device such that a developer, which adheres to said transferring device, is transferred to said image carrier, wherein when said selecting device selects the first mode, said controller controls said transferring device so that the cleaning operation of said transferring device is executed, while when said selecting device selects the second mode, said controller controls said transferring device so that the cleaning operation of said transferring device is not executed.

15. An image forming apparatus according to claim 14, further comprising:

a cleaner for cleaning the developer on said image carrier.

16. An image forming apparatus according to claim 14, wherein said image carrier is a photosensitive body, the image forming apparatus further comprising:

a developing device for developing a latent image formed on said photosensitive body by the developer.

17. An image forming apparatus according to claim 14, wherein said image carrier is a photosensitive body.

* * * * *

UNITED STATES PATENT AND TRADEMARK OFFICE

CERTIFICATE OF CORRECTION

PATENT NO. : 6,985,679 B2
APPLICATION NO. : 10/357360
DATED : January 10, 2006
INVENTOR(S) : Shokyo Koh et al.

It is certified that error appears in the above-identified patent and that said Letters Patent is hereby corrected as shown below:

ON THE COVER PAGE:

UNDER REFERENCES CITED, ITEM (56):

"2000214664 A" should read --2002-214664 A--.

COLUMN 1:

Line 43, "exist" should read --exists--.

COLUMN 3:

Line 60, "the." should read --the--.

COLUMN 4:

Line 27, "conveyed" should read --conveyed to--.

COLUMN 8:

Line 15, "superpose" should read --superposes--;
Line 16, "outputting" should read --outputs--; and
Line 55, "12-tab-sheet" (second occurrence) should read --12-tab-sheets--.

COLUMN 10:

Line 52, "images" should read --image--; and
Line 60, "judge, the" should read --judge the--.

UNITED STATES PATENT AND TRADEMARK OFFICE

CERTIFICATE OF CORRECTION

PATENT NO. : 6,985,679 B2
APPLICATION NO. : 10/357360
DATED : January 10, 2006
INVENTOR(S) : Shokyo Koh et al.

It is certified that error appears in the above-identified patent and that said Letters Patent is hereby corrected as shown below:

COLUMN 11:

Line 39, “case” should read --case in which--;
Line 45, “case” should read --case in which--;
Line 48, “an enough” should read --enough--; and
Line 59, “has not” should read --does not have--.

COLUMN 14:

Line 32, “legal,” should read --legal),--.

COLUMN 15:

Line 32, “has” should read --have--.

COLUMN 16:

Line 42, “case” should read --case in which--;
Line 48, “case” should read --case in which--; and
Line 51, “an enough” should read --enough--.

COLUMN 18:

Line 11, “yet” should read --yet been--.

COLUMN 20:

Line 21, “has” should read --have--; and
Line 24, “has” should read --have--.

UNITED STATES PATENT AND TRADEMARK OFFICE

CERTIFICATE OF CORRECTION

PATENT NO. : 6,985,679 B2
APPLICATION NO. : 10/357360
DATED : January 10, 2006
INVENTOR(S) : Shokyo Koh et al.

It is certified that error appears in the above-identified patent and that said Letters Patent is hereby corrected as shown below:

COLUMN 21:

Line 13, “case” should read --case in which--;
Line 19, “case” should read --case in which--;
Line 21, “an enough” should read --enough--; and
Line 31, “remained” should read --remaining--.

Signed and Sealed this

First Day of August, 2006

JON W. DUDAS
*Director of the United States Patent and Trademark Office*